US012117002B2

(12) United States Patent
Park et al.

(10) Patent No.: US 12,117,002 B2
(45) Date of Patent: Oct. 15, 2024

(54) SCROLL COMPRESSOR HAVING OIL SUPPLY GROOVE IN COMMUNICATION WITH OIL SUPPLY HOLE DEFINED FROM OIL PASSAGE TO ROTATING SHAFT SURFACE

(71) Applicant: LG Electronics Inc., Seoul (KR)

(72) Inventors: Honghee Park, Seoul (KR); Jaesang Lee, Seoul (KR); Byeonghun Yu, Seoul (KR); Sooho Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/149,973

(22) Filed: Jan. 4, 2023

(65) Prior Publication Data

US 2023/0383747 A1 Nov. 30, 2023

(30) Foreign Application Priority Data

May 30, 2022 (KR) ..... 10-2022-0066272

(51) Int. Cl.

| | |
|---|---|
| ***F04C 2/00*** | (2006.01) |
| ***F04C 2/02*** | (2006.01) |
| ***F04C 15/00*** | (2006.01) |
| ***F04C 18/00*** | (2006.01) |

(Continued)

(52) U.S. Cl.

CPC ..... *F04C 2/025* (2013.01); *F04C 15/0088* (2013.01); *F04C 29/023* (2013.01); *F04C 23/008* (2013.01); *F04C 2240/603* (2013.01)

(58) Field of Classification Search

CPC .... F04C 2/025; F04C 15/008; F04C 18/0215; F04C 23/008; F04C 29/023; F04C 29/025; F04C 29/026; F04C 29/028; F04C 2240/603

See application file for complete search history.

(56) References Cited

U.S. PATENT DOCUMENTS

| | | | |
|---|---|---|---|
| 10,781,817 | B2 | 9/2020 | Lee et al. |
| 2015/0345493 | A1 | 12/2015 | Lochner et al. |
| 2016/0195090 | A1 | 7/2016 | Toyama |

FOREIGN PATENT DOCUMENTS

| | | | |
|---|---|---|---|
| CN | 101749234 | 6/2010 | |
| CN | 107859625 | 3/2018 | |
| CN | 108457857 A * | 8/2018 | ..... F04C 18/0215 |

(Continued)

OTHER PUBLICATIONS

JP-2002349460-A—Shimada—Scroll Type Compressor—Dec. 4, 2002—Machine English Translation. (Year: 2002).*

(Continued)

*Primary Examiner* — Theresa Trieu

(74) *Attorney, Agent, or Firm* — Fish & Richardson P.C.

(57) ABSTRACT

A scroll compressor is disclosed. The scroll compressor may include an oil supply hole penetrating from an oil passage to an outer circumferential surface of a rotating shaft, and an oil supply groove communicating with the oil supply hole and formed along the outer circumferential surface of the rotating shaft. The oil supply groove may be provided in plurality axially spaced apart by a preset distance. This can prevent the oil supply groove from invading an oil film section and increase centrifugal force against oil in the oil supply groove, thereby suppressing friction loss and wear between a main frame and the rotating shaft.

18 Claims, 16 Drawing Sheets

(51) Int. Cl.
*F04C 29/02* (2006.01)
*F04C 23/00* (2006.01)

(56) References Cited

FOREIGN PATENT DOCUMENTS

| | | | | | |
|---|---|---|---|---|---|
| CN | 113187728 | A | * | 7/2021 | ..... F04C 18/0215 |
| GB | 2292773 | A | * | 3/1996 | ..... F04C 23/008 |
| JP | 61268890 | A | * | 11/1986 | ..... F04C 18/0215 |
| JP | 2002349460 | A | * | 12/2002 | ..... F04C 18/0215 |
| JP | 2014-206149 | | | 10/2014 | |
| JP | 6618663 | | | 12/2019 | |
| KR | 100480127 | | | 4/2005 | |
| KR | 10-2005- 0063832 | | | 6/2005 | |

OTHER PUBLICATIONS

CN-108457857-A—Otsu et al.—Scroll compressor and refrigeration cycle device having same—Aug. 8, 2018—Machine English Translation. (Year: 2018).*
CN113187728 -A—Scroll compressor and air conditioner—Jul. 30, 2021—Machine English Translation. (Year: 2021).*
JP2014-206149A—Masumoto et al.—Rotary Hermetic Compressor—Oct. 30, 2014—English Machine Translation ( Year: 2014).*
Extended European Search Report in European Appln. No. 22217320.5, mailed on Oct. 19, 2023, 10 pages.
Office Action in Korean Appln. No. 10-2022-0066272, mailed on Sep. 20, 2023, 8 pages (with English translation).

* cited by examiner

SCROLL COMPRESSOR HAVING OIL SUPPLY GROOVE IN COMMUNICATION WITH OIL SUPPLY HOLE DEFINED FROM OIL PASSAGE TO ROTATING SHAFT SURFACE

CROSS-REFERENCE TO RELATED APPLICATION

Pursuant to 35 U.S.C. § 119(a), this application claims the benefit of the earlier filing date and the right of priority to Korean Patent Application No. 10-2022-0066272, filed on May 2022, the contents of which are incorporated by reference herein in their entirety.

TECHNICAL FIELD

The present disclosure relates to a scroll compressor, and more particularly, a hermetic scroll compressor.

BACKGROUND

A scroll compressor has advantages of obtaining a relatively high compression ratio, as compared with other types of compressors, because refrigerant is continuously compressed by a shape of scrolls engaged with each other and of obtaining stable torques by smooth connection of suction, compression, and discharge strokes. By virtue of those advantages, the scroll compressor is widely used for compressing refrigerant in an air conditioner and the like.

Scroll compressors may be classified into a top-compression type or a bottom-compression type depending on positions of a drive motor constituting a drive unit or a motor unit and a compression unit. The top-compression type is configured such that the compression unit is located above the drive motor, whereas the bottom-compression type is configured such that the compression unit is located below the drive motor. This classification is made based on an example in which a casing is vertically installed. When the casing is horizontally installed, a left side may be defined as a top and a right side as a bottom.

Also, scroll compressors may be classified into a high-pressure type and a low-pressure type according to how refrigerant is suctioned. The high-pressure type is configured such that a refrigerant suction pipe directly communicates with a suction chamber to suction refrigerant into a compression chamber (the suction chamber) without passing through an inner space of a casing, whereas the low-pressure type is configured such that the refrigerant suction pipe communicates with the inner space of the casing to suction the refrigerant into the compression chamber (the suction chamber) after passing through the inner space of the casing. Related art discloses a top-compression and low-pressure type scroll compressor.

In the related art top-compression and low-pressure type scroll compressor (hereinafter, abbreviated as a scroll compressor), oil stored in an opposite side of a compression unit is pumped up toward the compression unit through an oil passage that is defined through both ends of a rotating shaft. In this case, the oil passage is eccentric by a preset distance or inclined by a preset angle with respect to a center of the rotating shaft so that centrifugal force is generated in the oil passage when the rotating shaft rotates.

In the related art scroll compressor, an upper half portion of the rotating shaft is inserted through a bearing hole of a main frame to be supported. In this case, the upper half portion of the rotating shaft facing the bearing hole of the main frame is provided with an oil supply hole and an oil supply groove that communicate with the oil passage, such that the oil pumped up through the oil passage lubricates a bearing surface between the main frame and the rotating shaft.

However, in the related art scroll compressor, an inclination (inclination angle) of the oil supply groove or a length of the oil supply groove may not be sufficiently secured in consideration of an oil film on the bearing surface. This may reduce the centrifugal force in the oil supply groove, which may interfere with a smooth supply of the oil of the oil passage to the bearing surface, thereby causing friction loss or wear on the bearing surface. Conversely, if the inclination (inclination angle) of the oil supply groove or the length of the oil supply groove is sufficiently secured, an end of the oil supply groove may be located excessively close to a section where oil film pressure greatly acts (hereinafter, oil film pressure section) or may severely invade the oil film pressure section. This may cause a reduction of a bearing surface due to damage on the oil film and thereby bring about the friction loss or wear on the bearing surface.

SUMMARY

The present disclosure describes a scroll compressor capable of suppressing friction loss and wear on a bearing surface between a main frame and a rotating shaft by securing an amount of oil to be supplied to the bearing surface.

The present disclosure also describes a scroll compressor capable of securing an amount of oil to be supplied by increasing centrifugal force with respect to an oil supply groove on a bearing surface between a main frame and a rotating shaft.

The present disclosure further describes a scroll compressor capable of effectively suppressing friction loss and wear on a bearing surface between a main frame and a rotating shaft by increasing centrifugal force with respect to an oil supply groove on the bearing surface without causing damage on an oil film due to the oil supply groove being excessively close to or invading an oil film pressure section.

In order to achieve those aspects and other advantages of the present disclosure, there is provided a scroll compressor that may include a main frame, a non-orbiting scroll, an orbiting scroll, and a rotating shaft. The main frame may include a bearing hole formed therethrough in an axial direction. The non-orbiting scroll may be disposed on one side of the main frame. The orbiting scroll may be engaged with the non-orbiting scroll to define compression chambers together with the non-orbiting scroll while performing an orbiting motion. The rotating shaft may be inserted through the bearing hole of the main frame to be supported in a radial direction and coupled to the orbiting scroll to transmit rotational force. The rotating shaft may include an oil passage formed through both ends thereof in the axial direction, an oil supply hole formed through from the oil passage to an outer circumferential surface of the rotating shaft toward the bearing hole of the main frame, and an oil supply groove communicating with the oil supply hole and formed along the outer circumferential surface of the rotating shaft. The oil supply groove may be provided in plurality spaced apart by a preset distance in the axial direction. This can prevent the oil supply groove from invading an oil film section and increase centrifugal force against oil in the oil supply groove, thereby suppressing friction loss and wear between a main frame and the rotating shaft.

For example, the plurality of oil supply grooves may include a first oil supply groove and a second oil supply groove. The first oil supply groove may have one end connected to the oil supply hole, and another end located higher than the one end. The second oil supply groove may have one end spaced apart from the oil supply hole, and another end located higher than the one end. The first oil supply groove and the second oil supply groove may be spaced apart from each other in the axial direction of the rotating shaft. This can configure the oil supply groove in a multi-step structure and increase centrifugal force of the oil supply groove in the same section in the circumferential direction.

In one example, the first oil supply groove and the second oil supply groove may be the same as each other in terms of at least one of inclination angle, length, height, and cross-sectional area. This can increase centrifugal force of the oil supply groove in the same section in the circumferential direction and also facilitate machining of the oil supply groove.

In another example, the first oil supply groove and the second oil supply groove may be different from each other in terms of at least one of inclination angle, length, height, and cross-sectional area. This can optimize a standard of the oil supply groove in the same section in the circumferential direction, thereby further increasing the centrifugal force in the oil supply groove.

Specifically, the inclination angle of the first oil supply groove may be larger than the inclination angle of the second oil supply groove. This can more increase the centrifugal force in the first oil supply groove that directly communicates with the oil supply hole, thereby increasing an amount of oil to be supplied.

Specifically, the length of the first oil supply groove may be shorter than the length of the second oil supply groove. Accordingly, the centrifugal force can increase by more increasing the inclination of the first oil supply groove, instead of decreasing the length of the first oil supply groove.

Specifically, the height of the first oil supply groove may be lower than the height of the second oil supply groove. Accordingly, the centrifugal force can increase by more increasing the inclination of the first oil supply groove, instead of decreasing the height of the first oil supply groove.

Specifically, the cross-sectional area of the first oil supply groove may be larger than the cross-sectional area of the second oil supply groove. Accordingly, an amount of oil to be supplied can increase, based on the same centrifugal force, by enlarging the cross-sectional area of the first oil supply groove communicating with the oil supply hole.

In still another example, a communication groove connecting the first oil supply groove and the second oil supply groove may be formed between the first oil supply groove and the second oil supply groove. As the first oil supply groove and the second oil supply groove communicate with each other through the communication groove, the plurality of oil supply grooves can communicate with the single oil supply hole while being spaced apart from each other. In addition, as the plurality of oil supply grooves are connected to each other, a total length of the oil supply groove can extend and an amount of oil to be supplied can increase, so as to further reduce friction loss and wear between the main frame and the rotating shaft.

Specifically, the communication groove may be formed in a circumferential direction that is orthogonal to the axial direction of the rotating shaft. This can facilitate machining of the communication groove and allow oil to be stored in the communication groove such that the oil can be quickly supplied between the main frame and the rotating shaft when the compressor is restarted.

Specifically, the communication groove may be inclined by a preset angle with respect to a circumferential direction that is orthogonal to the axial direction of the rotating shaft. Accordingly, oil can quickly move between the oil supply groove and the communication groove or an oil storage capacity in the communication groove can increase.

More specifically, the communication groove may be formed such that one end thereof connected to the first oil supply groove is lower than another end connected to the second oil supply groove. This can reduce a degree of bending between the oil supply groove and the communication groove so as to reduce flow resistance in the overall oil supply groove, thereby increasing an amount of oil to be supplied.

More specifically, an inclination angle of the communication groove may be smaller than or equal to an inclination angle of the first oil supply groove or the second oil supply groove. With the configuration, flow resistance between the oil supply groove and the communication groove can be appropriately reduced and an inclination or length of the first oil supply groove and/or the second oil supply groove can be secured, thereby obtaining high centrifugal force.

In still another example, one end of the first oil supply groove connected to the oil supply hole and one end of the second oil supply groove connected to the communication groove may be located on the same axial line. With the configuration, the both oil supply grooves can be symmetrical to each other to increase machinability for the oil supply grooves and to secure a maximum length of the oil supply grooves in the same circumferential section, thereby increasing centrifugal force in the oil supply grooves.

In still another example, one end of the first oil supply groove connected to the oil supply hole and one end of the second oil supply groove connected to the communication groove may be located on different axial lines. This can enhance the degree of design freedom for the standard of the oil supply groove, thereby increasing centrifugal force or improving machinability.

Specifically, the one end of the second oil supply groove may be located more forward than the oil supply hole based on the rotational direction of the rotating shaft. This can further increase the inclination of the second oil supply groove as well as the first oil supply groove, so as to increase the centrifugal force in the oil supply grooves, an entire length of the oil supply grooves, and a lubrication area, thereby more effectively lubricating between the main frame and the rotating shaft.

In still another example, the oil supply hole may be provided by one in number, and the plurality of oil supply grooves may be connected to each other such that one end is connected to the oil supply hole. With this configuration, the inclination or length of the oil supply holes can be secured while forming only the single oil supply hole, thereby increasing the centrifugal force in the oil supply grooves.

In still another example, the oil supply hole may be provided in plurality spaced apart in the axial direction. The plurality of oil supply grooves may be independently connected to the plurality of oil supply holes. With the configuration, a large inclination of each oil supply groove can be obtained in the same section in the circumferential direction, thereby increasing the centrifugal force in the oil supply grooves.

DETAILED DESCRIPTION

Description will now be given in detail of a scroll compressor according to one embodiment disclosed herein, with reference to the accompanying drawings.

Scroll compressors may be classified into a high-pressure scroll compressor and a low-pressure scroll compressor according to a refrigerant suction path. Hereinafter, a low-pressure scroll compressor in which an inner space of a casing is divided into a low-pressure part and a high-pressure part by a high/low pressure separation plate and a refrigerant suction pipe communicates with the low-pressure part will be described as an example.

In addition, scroll compressors may be classified into a non-orbiting back pressure type in which a non-orbiting scroll is pressed toward an orbiting scroll and an orbiting back pressure type in which the orbiting scroll is pressed toward the non-orbiting scroll. Hereinafter, a scroll compressor according to a non-orbiting back pressure type will be mainly described. However, the present disclosure may also be equally applied to the orbiting back pressure type.

In addition, scroll compressors may be classified into a vertical scroll compressor in which a rotating shaft is disposed perpendicular to the ground and a horizontal scroll compressor in which the rotating shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, the present disclosure may also be equally applied to the horizontal scroll compressor.

Also, scroll compressors may be classified into a top-compression type and a bottom-compression type depending on a position of a compression unit relative to a motor unit. Hereinafter, a top-compression type scroll compressor that is installed vertically and has a compression unit located above a motor unit will be mainly described.

In addition, scroll compressors may be classified into a fixed-radius type and a variable-radius type depending on how an orbiting scroll performs an orbiting motion. Hereinafter, a variable-radius type scroll compressor will be mainly described.

Figure 1:
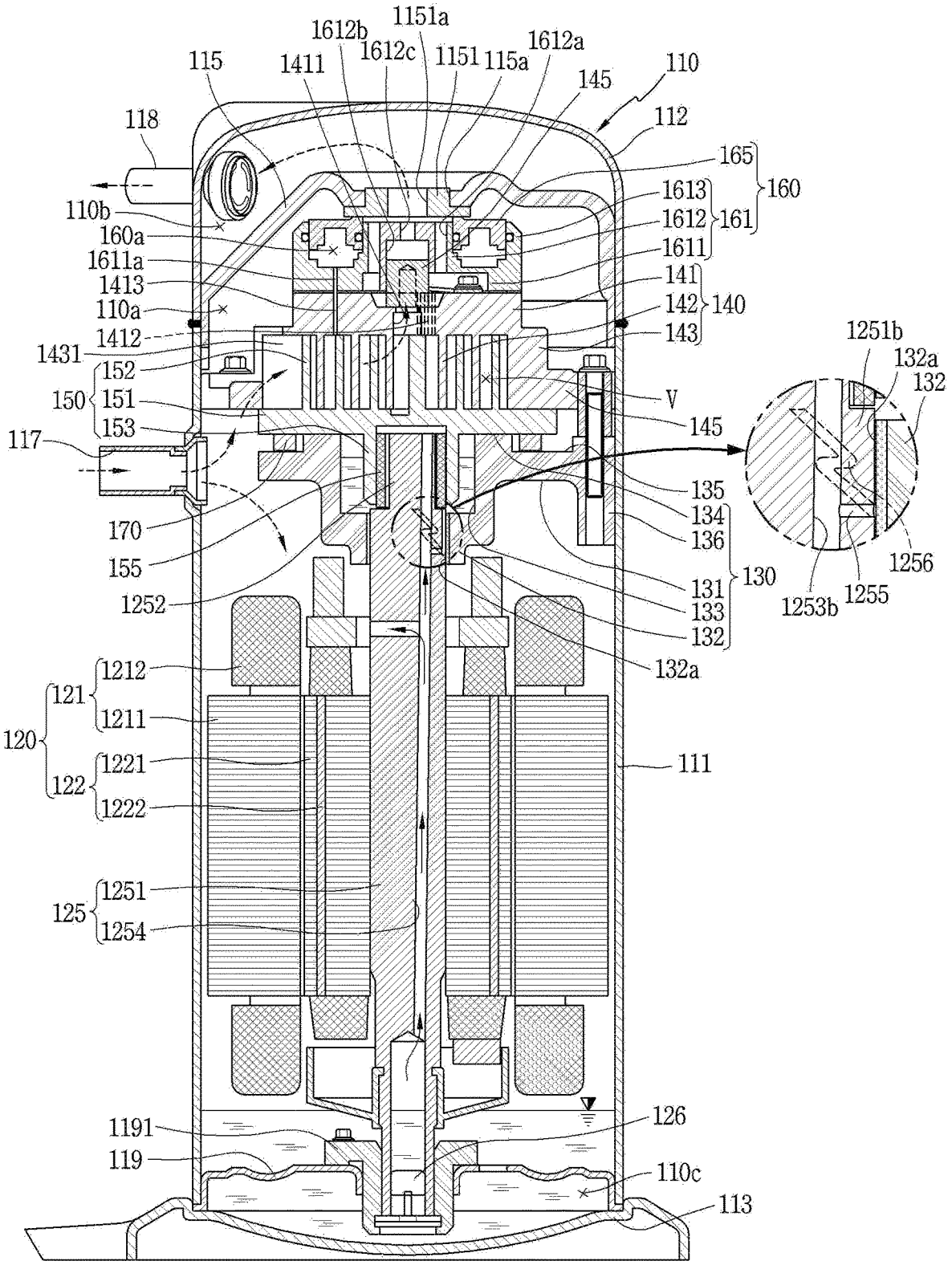
FIG. 1 is a longitudinal sectional view illustrating an inner structure of a scroll compressor in accordance with an embodiment.

FIG. 1 is a longitudinal sectional view illustrating an inner structure of a scroll compressor in accordance with an embodiment.

Referring to FIG. 1, a scroll compressor according to an embodiment includes a drive motor 120 disposed in a lower half portion of a casing 110, and a main frame 130, a non-orbiting scroll 140, an orbiting scroll 150, and a back pressure chamber assembly 160 that constitute a compression unit disposed above the drive motor 120. The motor unit is coupled to one end of a rotating shaft 125, and the compression unit is coupled to another end of the rotating shaft 125. Accordingly, the compression unit is connected to the motor unit by the rotating shaft 125 to be operated by rotational force of the motor unit.

The casing 110 includes a cylindrical shell 111, an upper cap 112, and a lower cap 113.

The cylindrical shell 111 has a cylindrical shape with upper and lower ends open, and the drive motor 120 and the main frame 130 is fitted on an inner circumferential surface of the cylindrical shell 111. A terminal bracket is coupled to an upper half portion of the cylindrical shell 111. A terminal for transmitting external power to the drive motor 120 is coupled through the terminal bracket. A refrigerant suction pipe 117 to be explained later is coupled to the upper half portion of the cylindrical shell 111, for example, above the drive motor 120.

The upper cap 112 is coupled to cover the upper opening of the cylindrical shell 111. The lower cap 113 is coupled to cover the lower opening of the cylindrical shell 111. A rim of a high/low pressure separation plate 115 to be explained later is inserted between the cylindrical shell 111 and the upper cap 112 to be welded on the cylindrical shell 111 and the upper cap 112. A rim of a support bracket 116 to be described later is inserted between the cylindrical shell 111 and the lower cap 113 to be welded on the cylindrical shell 111 and the lower cap 113. Accordingly, the inner space of the casing 110 can be sealed.

The rim of the high/low pressure separation plate 115 is welded on the casing 110 as described above. A central portion of the high/low pressure separation plate 115 is bent and protrude toward an upper surface of the upper cap 112 so as to be disposed above the back pressure chamber assembly 160 to be described later. A refrigerant suction pipe 117 communicates with a space below the high/low pressure separation plate 115, and a refrigerant discharge pipe 118 communicates with a space above the high/low pressure separation plate 115. Accordingly, the low-pressure part 110*a* constituting a suction space is formed below the high/low pressure separation plate 115, and a high-pressure part 110*b* constituting a discharge space is formed above the high/low pressure separation plate 115.

In addition, a through hole 115*a* is formed through a center of the high/low pressure separation plate 115. A sealing plate 1151 from which a floating plate 165 to be described later is detachable is inserted into the through hole 115*a*. The low-pressure part 110*a* and the high-pressure part 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 defines an oil storage space 110*c* together with the lower portion of the cylindrical shell 111 that defines the low-pressure part 110*a*. In other words, the oil storage space 110*c* is defined in the lower portion of the low-pressure part 110*a*. The oil storage space 110*c* thus defines a part of the low-pressure part 110*a*. An oil pickup 126 to be described later is located in the oil storage space 110*c*, to pump up oil stored in the oil storage space 110*c* so as to be supplied to a sliding part through an oil passage 1253 of the rotating shaft 125, which will be described later, during an operation of the compressor.

Referring to FIG. 1, the drive motor 120 according to the embodiment is disposed in a lower half portion of the low-pressure part 110*a* and includes a stator 121 and a rotor 122. The stator 121 is shrink-fitted to an inner wall surface of the casing 111, and the rotor 122 is rotatably provided inside the stator 121.

The stator 121 includes a stator core 1211 and a stator coil 1212.

The stator core 1211 is formed in a cylindrical shape and is shrink-fitted onto the inner circumferential surface of the cylindrical shell 111. The stator coil 1212 may be wound around the stator core 1211 and may be electrically connected to an external power source through a terminal that is coupled through the casing 110.

The rotor 122 includes a rotor core 1221 and permanent magnets 1222.

The rotor core 1221 is formed in a cylindrical shape, and is rotatably inserted into the stator core 1211 with a preset gap therebetween. The permanent magnets 1222 is embedded in the rotor core 1222 at preset intervals along a circumferential direction.

In addition, the rotating shaft 125 is press-fitted to a center of the rotor core 1221. An eccentric portion 1252 is disposed on an upper end of the rotating shaft 125, and an orbiting scroll 150, which will be described later, is eccentrically coupled to the eccentric portion 125*a*. Accordingly, the rotational force of the drive motor 120 may be transmitted to the orbiting scroll 150 through the rotating shaft 125.

On the other hand, a lower end of the rotating shaft 125 is coupled to the rotor 122 and the upper end is coupled to the orbiting scroll 150 to be described later. Accordingly, the rotational force of the drive motor 120 is transmitted to the orbiting scroll 150 through the rotating shaft 125.

An oil passage 1253 to be explained later is formed through an inside of the rotating shaft 125. For example, the oil passage 1253 is defined through between the lower end and the upper end of the rotating shaft 125 and inclined by a preset angle so as to be getting away from an axial center in a direction from the lower end to the upper end. Accordingly, centrifugal force is generated in the oil passage 1253 to smoothly supply oil up to the upper end of the rotating shaft 125. In the following description, the lower end is defined as a position close to the drive motor 120, and the upper end is defined as a position far from the drive motor 120.

An oil supply hole 1255 and an oil supply groove 1256 are formed in an upper half portion of the oil passage 1253. For example, the oil supply hole 1255 and the oil supply groove 1256 are formed in a main bearing surface portion 1251*b* of the rotating shaft 125 that faces a main bearing portion 132 of the main frame 130. Accordingly, the oil pumped to the upper end through the oil passage 1253 is partially supplied to a main bearing surface (no reference numeral given) between the main bearing portion 132 and the main bearing surface portion 1251*b* through the oil supply hole 1255 and the oil supply groove 1256, so as to lubricate between the main bearing portion 132 and the main bearing surface portion 1251*b*. The oil supply hole 1255 and the oil supply groove 1256 will be described again later together with the rotating shaft 125.

An oil pickup 126 for suctioning up oil stored in the oil storage space 110*c* of the casing 110 is disposed in a lower end of the rotating shaft 125. The oil pickup 126 may be implemented by various pumps, such as a centrifugal pump, a viscous pump, a gear pump, and the like. This embodiment illustrates an example in which the centrifugal pump is employed. When the centrifugal pump is employed, a fabricating cost can be reduced.

Referring to FIG. 1, the main frame 130 is disposed on an upper side of the drive motor 120, and shrink-fitted to or welded on an inner wall surface of the cylindrical shell 111.

The main frame 130 includes a main flange portion 131, a main bearing portion 132, an orbiting space portion 133, a scroll support portion 134, an Oldham ring support portion 135, and a frame fixing portion 136.

The main flange portion 131 is formed in an annular shape and accommodated in the low-pressure part 110*a* of the casing 110. An outer diameter of the main flange portion 131 is smaller than an inner diameter of the cylindrical shell 111 so that an outer circumferential surface of the main flange portion 131 is spaced apart from an inner circumferential surface of the cylindrical shell 111. However, the frame fixing portion 136 to be described later protrudes from an outer circumferential surface of the main flange portion 131 in the radial direction. The outer circumferential surface of the frame fixing portion 136 is fixed in close contact with the inner circumferential surface of the casing 110. Accordingly, the main frame 130 is fixedly coupled to the casing 110.

The main bearing portion 132 protrudes downward from a lower surface of a central part of the main flange portion 131 toward the drive motor 120. A bearing hole 132*a* formed in a cylindrical shape penetrates through the main bearing portion 132 in the axial direction. The rotating shaft 125 is inserted into an inner circumferential surface of the bearing hole 132*a* and supported in the radial direction.

The orbiting space portion 133 is recessed from the center part of the main flange portion 131 toward the main bearing portion 132 to have a predetermined depth and outer diameter. The outer diameter of the orbiting space portion 133 is larger than an outer diameter of a rotating shaft coupling portion 153 that is disposed on the orbiting scroll 150 to be described later. Accordingly, the rotating shaft coupling portion 153 can be pivotally accommodated in the orbiting space portion 133.

The scroll support portion 134 is formed in an annular shape on an upper surface of the main flange portion 131 along a circumference of the orbiting space portion 133. Accordingly, the scroll support portion 134 supports a lower surface of an orbiting end plate 151 to be described later in the axial direction.

The Oldham ring support portion 135 is formed in an annular shape on an upper surface of the main flange portion 131 along an outer circumferential surface of the scroll support portion 134. Accordingly, the Oldham ring 170 is inserted into the Oldham ring support portion 135 to be pivotable.

The frame fixing portion 136 extends radially from an outer circumference of the Oldham ring support portion 135. The frame fixing portion 136 extends in an annular shape or extends to form a plurality of protrusions spaced apart from one another by preset distances. This embodiment illustrates an example in which the frame fixing portion 136 has a plurality of protrusions along the circumferential direction.

Referring to FIG. 1, the non-orbiting scroll 140 according to the embodiment is disposed on an upper portion of the main frame 130 with interposing the orbiting scroll 150 therebetween. The non-orbiting scroll 140 may be fixedly coupled to the main frame 130 or may be coupled to the main frame 130 to be movable up and down. The embodiment illustrates an example in which the non-orbiting scroll 140 is coupled to the main frame 130 to be movable relative to the main frame 130 in the axial direction.

The non-orbiting scroll 140 according to this embodiment includes a non-orbiting end plate 141, a non-orbiting wrap 143, a non-orbiting side wall portion 143, and a guide protrusion 144.

The non-orbiting end plate 141 is formed in a disk shape and disposed in a horizontal direction in the low-pressure part 110*a* of the casing 110. A discharge port 1411, a bypass hole 1412, and a scroll-side back pressure hole 1413 are formed through a central portion of the non-orbiting end plate 141 in the axial direction.

The discharge port 1411 is formed at a position where discharge pressure chambers (no reference numeral given) of both compression chambers V formed inside and outside the non-orbiting wrap 142 communicate with each other. The bypass hole 1412 communicates with the both compression chambers V, respectively. The scroll-side back pressure hole (hereinafter, referred to as a first back pressure hole) 1413 is spaced apart from the discharge port 1411 and the bypass hole 1412.

The non-orbiting wrap 142 extends from a lower surface of the non-orbiting end plate 141 facing the orbiting scroll 150 by a preset height in the axial direction. Here, the non-orbiting wrap 142 extends to be spirally rolled plural times toward the non-orbiting side wall portion 143 in the vicinity of the discharge port 1411. The non-orbiting wrap 142 may be formed to correspond to an orbiting wrap 152 to be described later, so as to define a pair of compression chambers V with the orbiting wrap 152.

The non-orbiting side wall portion 143 extends in an annular shape from a rim of a lower surface of the non-orbiting end plate 141 in the axial direction to surround the non-orbiting wrap 142. A suction port 1431 is formed through one side of an outer circumferential surface of the non-orbiting side wall portion 143 in the radial direction.

The guide protrusion 144 may extend radially from an outer circumferential surface of a lower side of the non-orbiting side wall portion 143. The guide protrusion 144 may be formed in a single annular shape or may be provided in plurality disposed at preset distances in the circumferential direction. This embodiment will be mainly described based on an example in which the plurality of guide protrusions 144 are disposed at preset distances along the circumferential direction.

Referring to FIG. 1, the orbiting scroll 150 according to the embodiment is disposed on an upper surface of the main frame 130 with being coupled to the rotating shaft 125. For example, the orbiting scroll 150 is disposed between the main frame 130 and the non-orbiting scroll 140. The Oldham ring 170 which is an anti-rotation mechanism is disposed between the orbiting scroll 130 and the main frame 130. Accordingly, the orbiting scroll 150 performs an orbiting motion relative to the non-orbiting scroll 140 while its rotational motion is restricted.

In detail, the orbiting scroll 150 includes an orbiting end plate 151, an orbiting wrap 152, and a rotating shaft coupling portion 153.

The orbiting end plate 151 is formed approximately in a disk shape. The orbiting end plate 151 is supported on the scroll support portion 134 of the main frame 130 in the axial direction. Accordingly, the orbiting end plate 151 and the scroll support portion 134 facing it defines an axial bearing surface (no reference numeral given).

The orbiting wrap 152 is engaged with the non-orbiting wrap 142 to define the compression chamber V. The orbiting wrap 152 is formed in a spiral shape by protruding from an upper surface of the orbiting end plate 151 facing the non-orbiting scroll 140 to a preset height. The orbiting wrap 152 is formed to correspond to the non-orbiting wrap 142 to perform an orbiting motion by being engaged with a non-orbiting wrap 142 of the non-orbiting scroll 140 to be described later.

The rotating shaft coupling portion 153 protrudes from a lower surface of the orbiting end plate 151 toward the main frame 130. The rotating shaft coupling portion 153 may have an inner circumferential surface formed in a cylindrical shape, so that an orbiting bearing configured as a bush bearing can be press-fitted. A sliding bush 155 is rotatably inserted into the orbiting bearing to configure the variable-radius scroll compressor.

Referring to FIG. 1, the back pressure chamber assembly 160 according to the embodiment is disposed at an upper side of the non-orbiting scroll 140. Accordingly, back pressure of a back pressure chamber 160*a* (to be precise, force that the back pressure acts on the back pressure chamber) is applied to the non-orbiting scroll 140. In other words, the non-orbiting scroll 140 is pressed toward the orbiting scroll 150 by the back pressure to seal the compression chamber V.

In detail, the back pressure chamber assembly 160 includes a back pressure plate 161 and a floating plate 165. The back pressure plate 161 is coupled to an upper surface of the non-orbiting end plate 141. The floating plate 165 may be slidably coupled to the back pressure plate 161 to define the back pressure chamber 160*a* together with the back pressure plate 161.

The back pressure plate 161 includes a fixed plate portion 1611, a first annular wall portion 1612, and a second annular wall portion 1613.

The fixed plate portion 1611 is formed in the form of an annular plate with a hollow center. A plate-side back pressure hole (hereinafter, referred to as a second back pressure hole) 1611*a* is formed through the fixed plate portion 1611. The second back pressure hole 1611*a* communicates with the first back pressure hole 1413 so as to communicate with the back pressure chamber 160*a*. Accordingly, the second back pressure hole 1611*a* communicates with the first back pressure hole 1413 so that the compression chamber V and the back pressure chamber 160*a* can communicate with each other.

The first annular wall portion 1612 and the second annular wall portion 1613 is formed on an upper surface of the fixed plate portion 1611 to surround inner and outer circumferential surfaces of the fixed plate portion 1611. Accordingly, the back pressure chamber 160*a* formed in the annular shape is defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 includes an intermediate discharge port 1612*a* that communicates with the discharge port 141*a* of the non-orbiting scroll 140. A valve guide groove 1612*b* into which a check valve (hereinafter, referred to as a discharge valve) 145 is slidably inserted is formed at an inner side of the intermediate discharge port 1612*a*. A backflow prevention hole 1612*c* is formed in the center of the valve guide groove 1612*b*. Accordingly the check valve 145 is selectively opened and closed between the discharge port 1411 and the intermediate discharge port 1612*a* to suppress a discharged refrigerant from flowing back into the compression chamber V.

The floating plate 165 is formed in an annular shape. The back pressure plate 161 may be formed of a light material. Accordingly, the floating plate 165 is detachably coupled to a lower surface of the high/low pressure separation plate 115 while moving in the axial direction with respect to the back pressure plate 161 depending on pressure of the back pressure chamber 160*a*. For example, when the floating plate 165 is brought into contact with the high/low pressure separation plate 115, the floating plate 165 serves to seal the low-pressure part 110*a* such that the discharged refrigerant is discharged to the high-pressure part 110*b* without leaking into the low-pressure part 110*a*.

The scroll compressor according to the embodiment of the present disclosure may operate as follows.

That is, when power is applied to the stator coil 121*a* of the stator 121, the rotor 122 rotates together with the rotating shaft 125. Then, the orbiting scroll 150 coupled to the rotating shaft 125 performs the orbiting motion with respect to the non-orbiting scroll 140, thereby forming a pair of compression chambers V between the orbiting wrap 152 and the non-orbiting wrap 142.

The compression chambers V gradually decrease in volume while moving from outside to inside according to the orbiting motion of the orbiting scroll 150. At this time, the refrigerant is suctioned into the low-pressure part 110*a* of the casing 110 through the refrigerant suction pipe 117. Some of this refrigerant are suctioned directly into the suction pressure chambers (no reference numeral given) of the both compression chambers V, respectively, while the remaining refrigerant first flows toward the drive motor 120 and then is suctioned into the suction pressure chambers (no reference numeral given).

The refrigerant suctioned into each suction pressure chamber (no reference numeral given) is compressed while moving toward the intermediate pressure chamber and the discharge pressure chamber (no reference numeral given) along a movement path of the compression chamber V. The refrigerant moved to the discharge pressure chamber (no reference numeral given) is then discharged to the high-pressure part 110*b* through the discharge port 141*a* and the intermediate discharge port 1612*a* while pushing the discharge valve 145. The refrigerant is filled in the high-pressure part 110*b* and then discharged through a condenser of a refrigeration cycle via the refrigerant discharge pipe 118. The series of processes is repetitively carried out.

In addition, another part of the refrigerant compressed while passing through the intermediate pressure chamber (no reference numeral given) also moves to the back pressure chamber 160*a* through the first back pressure hole 1413 before reaching the discharge port 1411, so that intermediate pressure can be formed in the back pressure chamber 160*a*. Then, the non-orbiting scroll 140 can move down toward the orbiting scroll 150 to seal a gap with the orbiting scroll 150, thereby suppressing leakage between the compression chambers.

Meanwhile, as described above, the lower end of the rotating shaft 125 rotates in a state immersed in the oil stored in the oil storage space 110*c* of the casing 110. Then, the oil in the oil storage space 110*c* is pumped by the oil pickup 126, and suctioned along the oil passage 1253 of the rotating shaft 125 to be scattered inside the rotating shaft coupling portion 153. A part of this oil flows down along the inner circumferential surface of the rotating shaft coupling portion 153 and is supplied to the bearing surface between adjacent members through the orbiting space portion 133 to lubricate the bearing surface.

In addition, a part of the oil pumped through the oil passage 1253 is guided to the oil supply hole 1255 that is formed between the main frame 130 and the rotating shaft 125 through a main bearing surface (no reference numeral given) in the middle of the oil passage 1253. This guided oil moves along the oil supply groove 1256, which communicates with the oil supply hole 1255 and extends along the main bearing surface to lubricate the entire main bearing surface.

However, during the operation of the compressor, centrifugal force is applied to the rotating shaft 125, and thereby a gap between the main frame 130 and the rotating shaft 125 is not constant. Due to this, a so-called oil film pressure section is generated in which an oil film is formed thin on the main bearing surface, and friction loss or wear may occur in this oil film pressure section.

The pumped oil can be quickly supplied to the oil film pressure section through the oil supply hole 1255 and the oil supply groove 1256 described above that are formed near the oil film pressure section. However, as the oil supply hole 1255 is located near the oil film pressure section, centrifugal force may not be sufficiently secured in the oil supply groove 1256 and thereby an amount of oil to be supplied may be decreased or the oil supply groove 1256 may extend even into the oil film pressure section to damage the oil film.

Therefore, in this embodiment, the oil supply groove 1256 is formed in a multi-stepped structure so as to be spaced an appropriate distance or angle (about 20° or more) apart from the oil film pressure section. This can increase centrifugal force for oil in the oil supply groove 1256 to secure an appropriate amount of oil to be supplied without damage on the oil film in the oil film pressure section.

Figure 2:
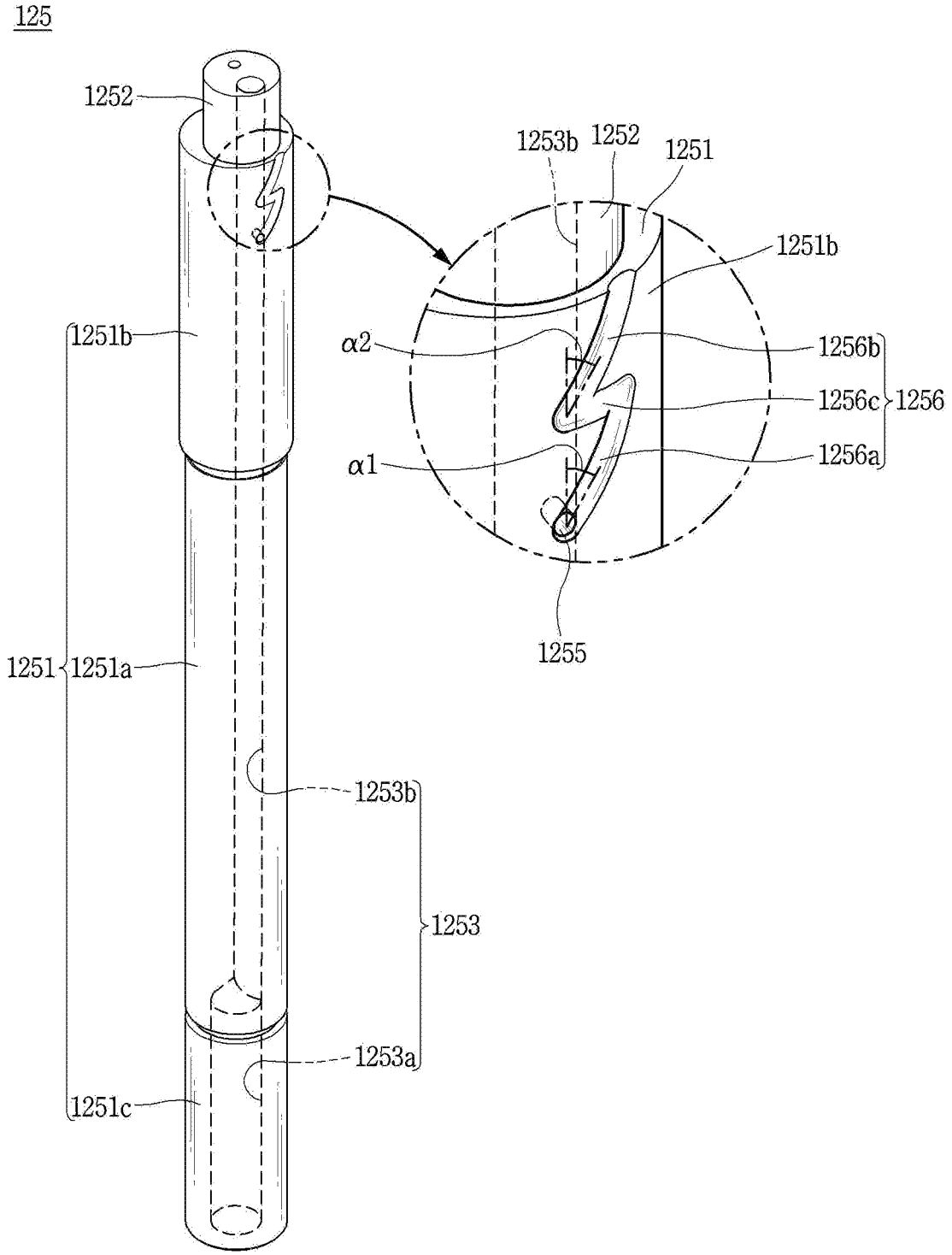
FIG. 2 is a perspective view illustrating a rotating shaft in accordance with an embodiment.
Figure 3:
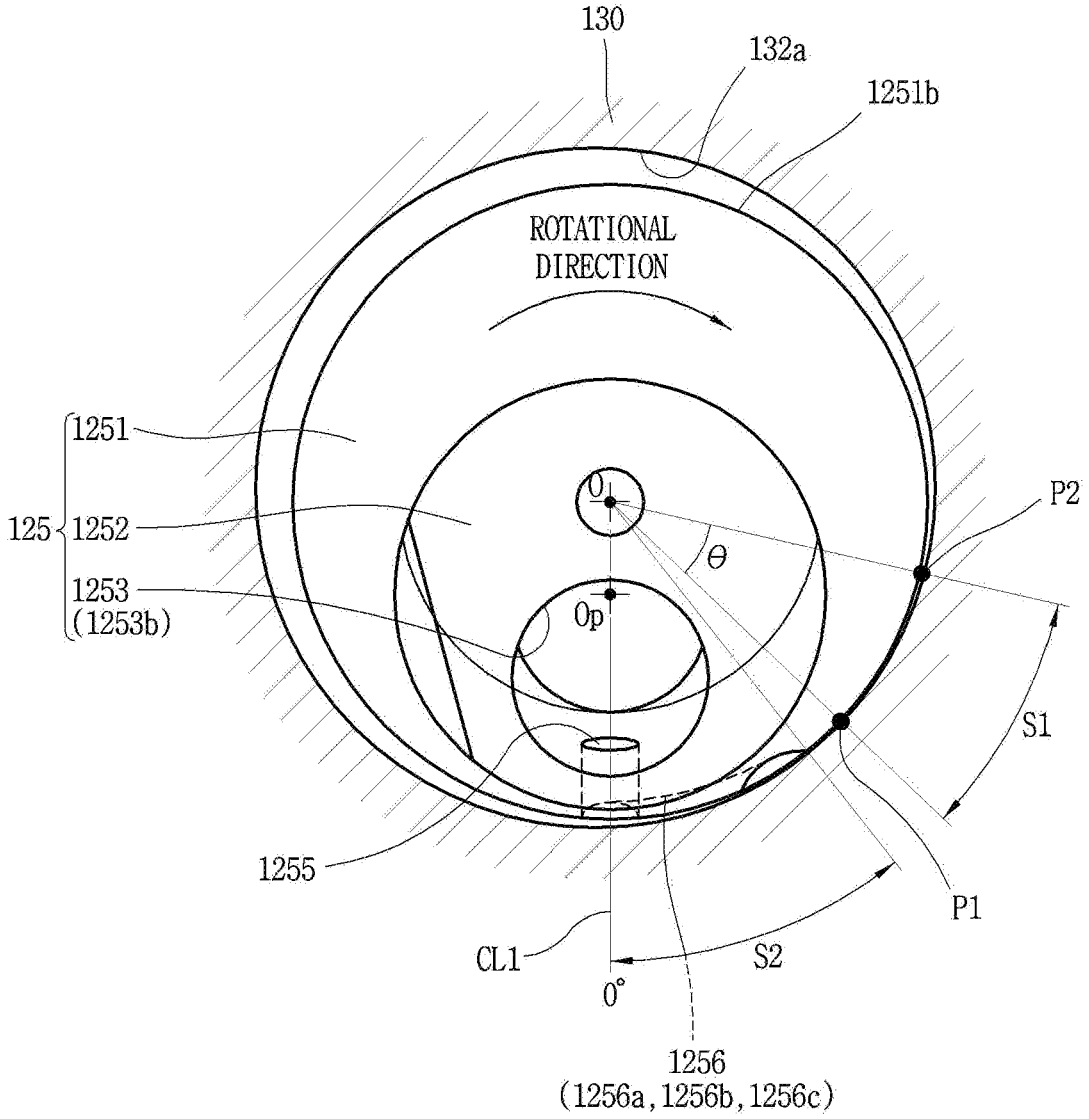
FIG. 3 is a planar view of FIG. 2.
Figure 4:
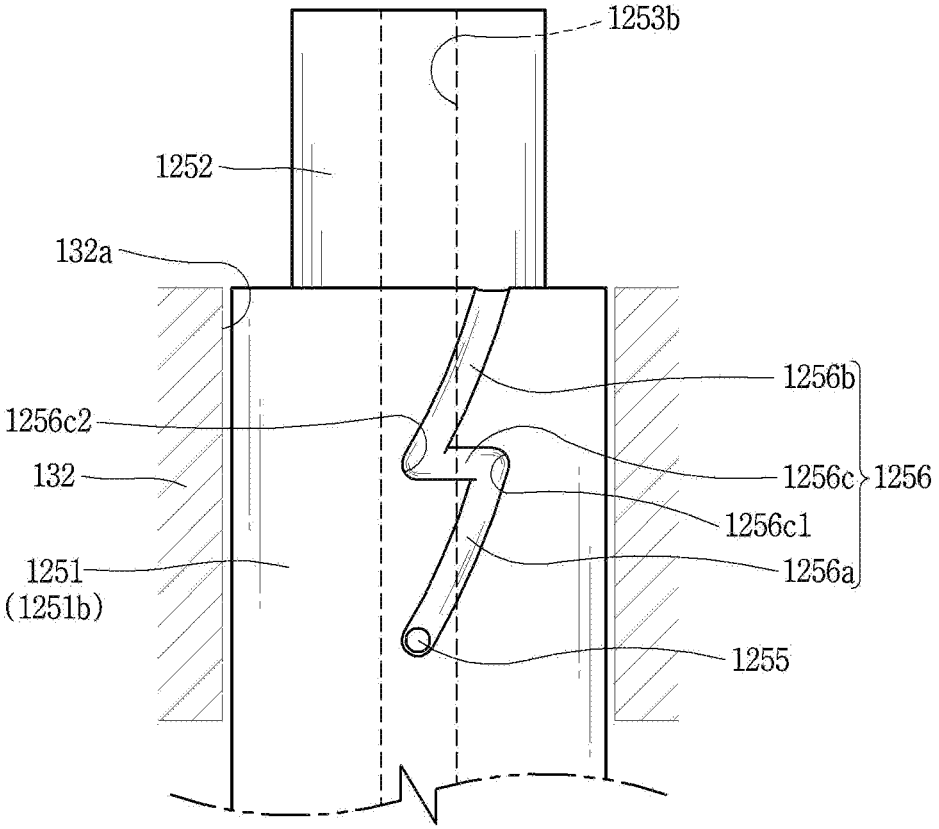
FIG. 4 is a front view illustrating one embodiment of an oil supply structure in FIG. 2.
Figure 5:
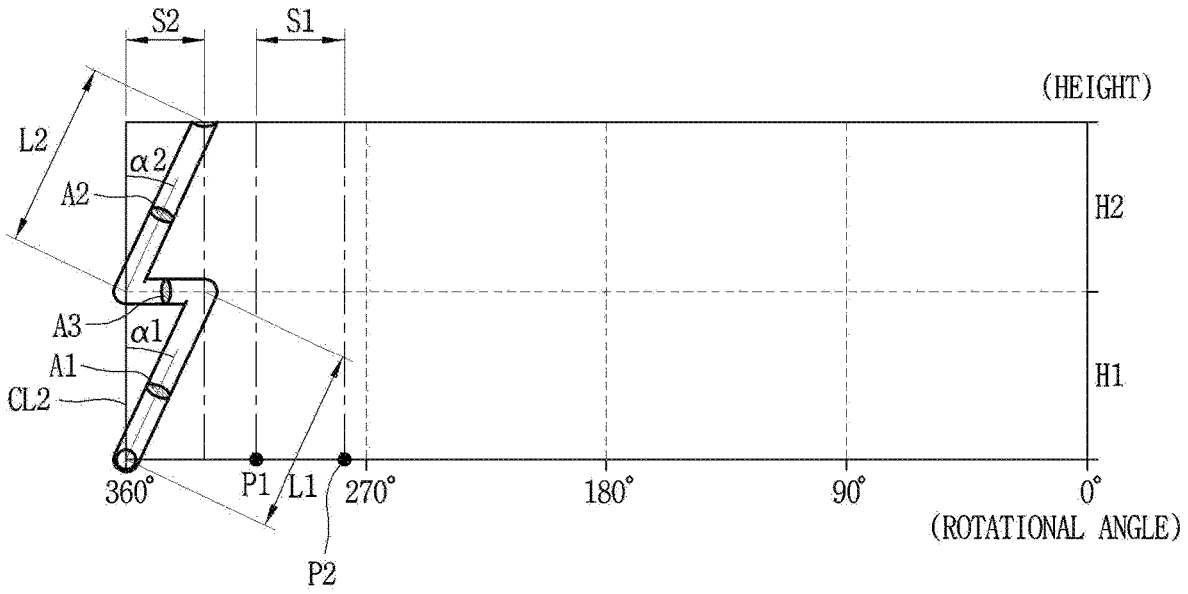
FIG. 5 is a development view of FIG. 4.

FIG. 2 is a perspective view illustrating a rotating shaft in accordance with an embodiment, FIG. 3 is a planar view of FIG. 2, FIG. 4 is a front view illustrating one embodiment of an oil supply structure in FIG. 2, and FIG. 5 is a development view of FIG. 4.

Referring to FIG. 2, the orbiting scroll 125 according to the embodiment includes a main shaft part 1251, an eccentric pin part 1252, and an oil passage 1253.

The main shaft part 1251 is a portion that is press-fitted to the rotor 122 of the drive motor 120 to receive the rotational force of the drive motor 120, and includes a rotor fixing portion 1251*a*, a main bearing surface portion 1251*b*, and a sub bearing surface portion 1251*c*. The rotor fixing portion 1251*a* may be press-fitted to the rotor 122, the main bearing surface portion 1251*b* may be inserted into the main bearing portion 132 of the main frame 130, and the sub bearing surface portion 1251*c* may be inserted into the sub bearing portion 1191 of the sub bearing 119, so as to be all supported.

For example, the main shaft portion 1251 has the main bearing surface portion 1251*b* on one axial side and the sub bearing surface portion 1251*c* on another axial side with the rotor fixing portion 1251*a* interposed therebetween. The main shaft portion 1251 may be formed with a single outer diameter. However, since the eccentric pin portion 1252 of the rotating shaft 125 is fixed and the rotor 122 is press-fitted to an opposite side, that is, the sub-bearing surface portion 1251*c*, an outer diameter of the rotor fixing portion 1251*a* and an outer diameter of the sub bearing surface portion 1251*c* may be smaller than an outer diameter of the main bearing surface portion 1251*b*. In this case, the outer diameter of the rotor fixing portion 1251*a* and the outer diameter of the sub bearing surface portion 1251*c* may be formed to be equal to each other, or the outer diameter of the rotor fixing portion 1251*a* may be formed to be larger than the outer diameter of the sub bearing surface portion 1251*c*.

The main bearing surface portion 1251*b* is provided with an oil supply hole 1255 and an oil supply groove 1256 communicating with each other in a second passage 1253*b* to be described later. The oil supply hole 1255 penetrates from an inner circumferential surface of the second passage 1253*b* to an outer circumferential surface of the main bearing surface portion 1251*b*, and the oil supply groove 1256 communicates with the oil supply hole 1255 and extends along the outer circumferential surface of the main bearing surface portion 1251*b*. Accordingly, a part of the oil pumped to the upper end of the rotating shaft 125 through the second passage 1253*b* is supplied through the oil supply hole 1255 and the oil supply groove 1256 to lubricate the main bearing surface. The oil supply hole 1255 and the oil supply groove 1256 will be described later together with an oil passage 1253 to be described later.

The eccentric pin portion 1252 is a portion coupled to the sliding bush 155 to transmit the rotational force of the drive motor 120 to the orbiting scroll 150, and axially extends from one end of the main shaft portion 1251, that is, an end portion of the main bearing surface portion 1251*b* to an opposite side of the rotor fixing portion 1251*a*.

A center of the eccentric pin portion 1252 is eccentric from an axial center O of the main shaft portion 1251 (or rotating shaft). An outer diameter of the eccentric pin portion 1252 is smaller than the outer diameter of the main shaft portion 1251, precisely, the outer diameter of the main bearing surface portion 1251*b*. However, an outer circumferential surface of the eccentric pin portion 1252 is formed on the same axial line as an outer circumferential surface of the main shaft portion 1251, that is, an outer circumferential surface of the main bearing surface portion 1251*b*, or may be located inward (toward the center) so as not to protrude compared to the outer circumferential surface of the main bearing surface portion 1251*b*. Accordingly, the rotating shaft 125 to which the rotor 122 is coupled can be inserted into the bearing hole 132*a* of the main frame 130.

An axial length of the eccentric pin portion 1252 may be longer than an axial length of the main frame 130, to be more precise, an axial length of the bearing hole 132*a* that defines the inner circumferential surface of the main bearing portion 132. In other words, the axial length of the eccentric pin portion 1252 may be longer than an axial length (no reference numeral given) of the main bearing surface portion 1251*b*. Accordingly, the eccentric pin portion 1252 can be inserted even into a portion of the orbiting end plate 151, such that the rotational force of the drive motor 120 can be effectively transmitted to the orbiting scroll 150.

Referring back to FIG. 1, the oil passage 1253 according to this embodiment includes a first passage 1253*a* and a second passage 1253*b*. A centrifugal pump such as a propeller may be disposed inside the first passage 1253*a*, and the second passage 1253*b* may be connected to an upper end of the first passage 1253*a* to be inclined. Accordingly, the oil stored in the lower end of the rotating shaft 125 is pumped by the first passage 1253*a* having the centrifugal pump and moves up to the upper end of the rotating shaft 125 by centrifugal force along the inclined second passage 1253*b*.

Specifically, the first passage 1253*a* is formed from the lower end of the rotating shaft 125 by a preset height along the axial direction. For example, the first passage 1253*a* may be formed from the lower end of the rotating shaft 125 up to a position where the sub bearing surface portion 1251*c* is located. If the first passage 1253*a* is too long in length, a starting point of the second passage 1253*b* at which centrifugal force is generated becomes too high, which reduces the substantial centrifugal force for pumping the oil. To the contrary, if the first passage 1253*a* is too short in length, a length of the second passage 1253*b* increases and an inclination angle of the second passage 1253*b* decreases, thereby reducing centrifugal force. Therefore, the first passage 1253*a* is preferably formed at a position where the greatest centrifugal force is generated in the second passage 1253*b*.

As described above, the second passage 1253*b* communicates with the upper end of the first passage 1253*a* and penetrates up to the upper end of the rotating shaft 125, that is, the upper end of the eccentric pin portion 1252. Accordingly, the oil passage 1253 is formed through from the lower end to the upper end of the rotating shaft 125.

The second passage 1253*b* is formed linearly, to be inclined by a preset angle with respect to the axial center O of the rotating shaft 125. For example, a lower end of the second passage 1253*b* may be located almost at the axial center O while an upper end of the second passage 1253*b* may be located away from the axial center O of the rotating shaft 125 rather than the lower end of the second passage 1253*b*. Accordingly, a moment arm can be elongated from the lower end to the upper end of the second passage 1253*b*, so as to generate centrifugal force.

The oil supply hole 1255 is formed in an upper half portion of the second passage 1253*b*, for example, at a position overlapping the main bearing portion 132 in the radial direction. In other words, the oil supply hole 1255 is formed to penetrate between the second passage 1253*b* of the rotating shaft 125 and the main bearing surface portion 1251*b*. Accordingly, a first end of the oil supply hole 1255 communicates with an inner circumferential surface of the second passage 1253*b*, and a second end of the oil supply hole 1255 communicates with an outer circumferential surface of the main bearing surface portion 1251*b*.

Referring to FIGS. 2 and 3, it is advantageous to form the oil supply hole 1255 at a position as close as a lowest end of the main bearing surface portion 1251*b*, in terms of lubrication between the main frame 130 and the rotating shaft 125. For example, the oil supply hole 1255 is formed within a range where the inner circumferential surface of the bearing hole 132*a* and the outer circumferential surface of the main bearing surface portion 1251*b* come in contact with each other. Here, a bottom dead center of the oil supply hole 1255 may be located substantially on the same line as a lower end of the main bearing portion 132, i.e., a lower end of the bearing hole 132*a* in the radial direction. Accordingly, oil flowing onto the main bearing surface through the oil supply hole 1255 is not scattered in the oil supply hole 1255 but lubricates the main bearing surface while being suctioned up along the oil supply groove 1256 to be described later.

The oil supply hole 1255 is formed at a position where the highest centrifugal force is generated. For example, the oil supply hole 1255 is formed to be located on a first virtual line CL1 that connects a center O of the main shaft portion 1251 and a center Op of the eccentric pin portion. Accordingly, the oil supply hole 1255 is located farthest from the center O of the main shaft portion 1251 to generate the highest centrifugal force against oil. This can allow the oil passing through the oil passage (to be more precise, the second passage) 1254 to be smoothly supplied to the bearing surface through the oil supply hole 1255.

An inner diameter of the oil supply hole 1255 may be smaller than an inner diameter of the second passage 1253*b*.

Accordingly, a decrease in rigidity of the rotating shaft 125 due to the oil supply hole 1255 can be suppressed, and the oil can be smoothly supplied to the bearing surface as the oil supply hole 1255 is formed at the position where the highest centrifugal force is generated.

Referring to FIGS. 3 to 5, the oil supply groove 1256 according to this embodiment includes a first oil supply groove 1256*a*, a second oil supply groove 1256*b*, and a communication groove 1256*c*. The first oil supply groove 1256*a* and the second oil supply groove 1256*b* are spaced apart in the axial direction, and the communication groove 1256*c* connects an upper end of the first oil supply groove 1256*a* and a lower end of the second oil supply groove 1256*b*. Accordingly, the oil supply groove 1256 can define a single passage. Hereinafter, an example in which the oil supply groove 1256 includes the first oil supply groove 1256*a* and the second oil supply groove 1256*b* will be described, but the present disclosure is not limited thereto. In other words, the oil supply groove 1256 may alternatively include more oil supply grooves, in addition to the first oil supply groove 1256*a* and the second oil supply groove 1256*b*, to be spaced apart from one another in the axial direction. Even in this case, adjacent oil supply grooves may be connected to each other through respective communication grooves.

The first oil supply groove 1256*a* and the second oil supply groove 1256*b* are formed symmetrically with respect to the communication groove 1256*c*. For example, a lower end of the first oil supply groove 1256*a* may be formed on the same axis as a lower end of the second oil supply groove 1256*b*, and an upper end of the first oil supply groove 1256*a* may be formed on the same axis as an upper end of the second oil supply groove 1256*b*. In other words, the first oil supply groove 1256*a* and the second oil supply groove 1256*b* may be formed in an oil supply guide section S2 that is defined by a circumferential distance between the oil supply hole 1255 and a minimum gap point P1. This can secure the maximum lengths of the first oil supply groove 1256*a* and the second oil supply groove 1256*b*, and at the same time can facilitate the machining of the first oil supply groove 1256*a* and the second oil supply groove 1256*b*.

However, in some cases, the lower ends of the first oil supply groove 1256*a* and the second oil supply groove 1256*b* and/or the upper ends of the first oil supply groove 1256*a* and the second oil supply groove 1256*b* may be formed on different axes. In other words, the first oil supply groove 1256*a* and/or the second oil supply groove 1256*b* may be formed outside the oil supply guide section S2. In this case, an amount of oil to be supplied can increase by increasing an inclination or length of the second oil supply groove 1256*b*. Hereinafter, a description will be given of an example in which the lower end of the first oil supply groove 1256*a* is located on the same axis as the lower end of the second oil supply groove 1256*b*, and the upper end of the first oil supply groove 1256*a* is located on the same axis as the upper end of the second oil supply groove 1256*b*.

Specifically, the first oil supply groove 1256*a* is located below the second oil supply groove 1256*b* with a preset distance therebetween. Accordingly, the first oil supply groove 1256*a* and the second oil supply groove 1256*b* are spaced apart from each other in the axial direction. However, the first oil supply groove 1256*a* and the second oil supply groove 1256*b* are connected to each other by the communication groove 1256*c*, which will be described later, to form a single oil supply passage.

The first oil supply groove 1256*a* is formed such that the lower end and the upper end thereof have different heights. Accordingly, the first oil supply groove 1256*a* is inclined by a preset inclination angle $\alpha$1 with respect to the axial direction or the axial center O of the rotating shaft 125. In the following description, an angle at which the first oil supply groove 1256*a* is inclined with respect to the axial direction of the rotating shaft 125 is defined as the inclination angle $\alpha$1.

The lower end of the first oil supply groove 1256*a* is located at the same position as the oil supply hole 1255, i.e., on the first virtual line CL1 that connects the center O of the main shaft portion 1251 and the center Op of the eccentric pin portion 1252. Accordingly, the lower end of the first oil supply groove 1256*a* can be located at a position, at which the highest centrifugal force is generated, together with the oil supply hole 1255, such that the oil pumped through the oil passage (second passage) 1253 can be smoothly and fully supplied to the oil supply hole 1255 and the oil supply groove 1256.

The upper end of the first oil supply groove 1256*a* extends up to a position close to the minimum gap point P1. For example, the upper end of the first oil supply groove 1256*a* may extend up to a position spaced about 20° apart from the minimum gap point P1. Accordingly, the upper end of the first oil supply groove 1256*a* can be sufficiently spaced apart from the oil film pressure section S1 that is defined as a section from the minimum gap point P1 to a maximum oil film pressure point P2, which is circumferentially spaced an attitude angle $\theta$ apart from the minimum gap point P1. This can suppress the oil film from being damaged due to the first oil supply groove 1256*a*.

Referring to FIGS. 3 to 5, the second oil supply groove 1256*b* is formed symmetrically with the first oil supply groove 1256*a* based on the communication groove 1256*c* as described above. For example, the lower end of the second oil supply groove 1256*b* is located on the same axial line with the lower end of the first oil supply groove 1256*a*, and the upper end of the second oil supply groove 1256*b* is located on the same axial line as the upper end of the first oil supply groove 1256*a*. Accordingly, the second oil supply groove 1256*b* can secure the maximum length of the oil supply groove 1256 together with the first oil supply groove 1256*b* within the range of the oil supply guide section S2.

The lower end of the second oil supply groove 1256*b* may be formed at the same height as the upper end of the first oil supply groove 1256*a*. In other words, the lower end of the second oil supply groove 1256*b* may communicate with the upper end of the first oil groove 1256*a* at the same height through the communication groove 1256*c* to be described later. Accordingly, the second oil supply groove 1256*b* can secure an appropriate length together with the first oil supply groove 1256*a*, and at the same time, the communication groove 1256*c* can be utilized as a kind of oil storage space.

Specifically, the second oil supply groove 1256*b* is formed such that the lower end and the upper end thereof are located at different heights. Accordingly, the second oil supply groove 1256*b* is inclined by a preset inclination angle $\alpha$2 with respect to the axial direction or the axial center O of the rotating shaft 125. In the following description, an angle at which the second oil supply groove 1256*b* is inclined with respect to the axial direction of the rotating shaft 125 is defined as the inclination angle $\alpha$2.

The lower end of the second oil supply groove 1256*b* is located on the same axial line as the oil supply hole 1255, like the first oil supply groove 1256*a*. Accordingly, the second oil supply groove 1256*b* can secure the maximum length within the range of the same oil supply guide section S2.

The upper end of the second oil supply groove 1256*b* extends up to a position close to the minimum gap point P1. For example, the upper end of the second oil supply groove 1256*b* may extend up to a position spaced about 20° apart from the minimum gap point P1. Accordingly, the upper end of the second oil supply groove 1256*b* can be sufficiently spaced apart from the oil film pressure section S1 that is defined as a section from the minimum gap point P1 to a maximum oil film pressure point P2, which is circumferentially spaced an attitude angle θ apart from the minimum gap point P1. This can suppress the oil film from being damaged due to the second oil supply groove 1256*b*.

In addition, the second oil supply groove 1256*b* and the first oil supply groove 1256*a* may be inclined at the same angle with respect to the axial direction of the rotating shaft 125. For example, the inclination angle α1 of the first oil supply groove 1256*a* and the inclination angle α2 of the second oil supply groove 1256*b* may be the same. This can facilitate the machining of the first oil supply groove 1256*a* and the second oil supply groove 1256*b*, while generating uniform centrifugal force in the first oil supply groove 1256*a* and the second oil supply groove 1256*b*.

Also, the second oil groove 1256*b* may extend by the same length as the first oil groove 1256*a*. For example, a length L1 of the first oil supply groove 1256*a* and a length L2 of the second oil supply groove 1256*b* may be the same. This can facilitate the machining of the first oil supply groove 1256*a* and the second oil supply groove 1256*b*, while generating uniform centrifugal force in the first oil supply groove 1256*a* and the second oil supply groove 1256*b*.

Also, the second oil supply groove 1256*b* may be located at the same axial height (hereinafter, abbreviated as a height) as the first oil supply groove 1256*a*. For example, a height H1 of the first oil supply groove 1256*a* and a height H2 of the second oil supply groove 1256*b* may be the same. This can facilitate the machining of the first oil supply groove 1256*a* and the second oil supply groove 1256*b*, while generating uniform centrifugal force in the first oil supply groove 1256*a* and the second oil supply groove 1256*b*.

Also, the second oil supply groove 1256*b* may have the same cross-sectional area as the first oil supply groove 1256*a*. For example, each of the first oil supply groove 1256*a* and the second oil supply groove 1256*b* has the same cross-sectional area between both ends thereof, and a cross-sectional area A1 of the first oil supply groove 1256*a* and a cross-sectional area A1 of the second oil supply groove 1256*b* may be the same as each other. This can facilitate the machining of the first oil supply groove 1256*a* and the second oil supply groove 1256*b*, while generating uniform centrifugal force in the first oil supply groove 1256*a* and the second oil supply groove 1256*b*.

Referring to FIGS. 3 to 5, the communication groove 1256*c* connects the upper end of the first oil supply groove 1256*a* and the lower end of the second oil supply groove 1256*b* to each other, as described above, and is located between the first oil supply groove 1256*a* and the second oil supply groove 1256*b*. For example, a rear end (hereinafter, a first end) 1256*c*1 of the communication groove 1256*c* is connected to the upper end of the first oil supply groove 1256*a*, and a front end (hereinafter, a second end) 1256*c*2 of the communication groove 1256*c* is connected to the lower end of the second oil supply groove 1256*b*. Accordingly, oil guided to the first oil supply groove 1256*a* can quickly move to the second oil supply groove 1256*b* through the communication groove 1256*c*. In the following description, the front end and the rear end are distinguished based on the rotational direction of the rotating shaft 125, and a side adjacent to the oil supply hole 1255 is defined as the front end and a side far from the oil supply hole 1255 is defined as a rear end, respectively.

The communication groove 1256*c* is formed at the same height in the circumferential direction orthogonal to the axial direction of the rotating shaft 125. In other words, an axial height between the both ends 1256*c*1 and 1256*c*2 of the communication groove 1256*c* is formed to be constant in the circumferential direction. Accordingly, during the operation of the compressor, the oil flowing through the first oil supply groove 1256*a* can quickly pass through the communication groove 1256*c* and then move to the second oil supply groove 1256*b*, thereby increasing a lubrication effect. On the other hand, when the compressor is stopped, the communication groove 1256*c* can define a kind of oil storage section so as to store a predetermined amount of oil, thereby reducing friction loss on the main bearing surface when the compressor is restarted.

A length L3 of the communication groove 1256*c* is shorter than the length L1 of the first oil supply groove 1256*a* and/or the length L2 of the second oil supply groove 1256*b*. Accordingly, even if the oil supply guide section S2 is narrow, the first oil supply groove 1256*a* and the second oil supply groove 1256*b* can be formed in the oil supply guide section S2.

As described above, the oil supply groove 1256 is divided into the first oil supply groove 1256*a* and the second oil supply groove 1256*b* that are connected by the communication groove 1256*c*. This increases the overall length and/or the inclination angle of the oil supply groove 1256. In other words, when the oil supply groove 1256 includes the plurality of oil supply grooves 1256*a* and 1256*b* connected to each other as in the embodiment, the overall length and/or inclination angle of the oil supply groove 1256 may increase, compared to a case where only one oil supply groove is provided.

This can improve centrifugal force against the oil in the oil supply groove 1256, thereby increasing an amount of oil to be supplied. With the configuration, since the oil supply groove 1256 is located outside the oil film pressure section S1 or as far as possible from the oil film pressure section S1, an oil film damage caused by the oil supply groove 1256 can be suppressed. This can reduce friction loss or wear due to a decrease in substantial bearing area, thereby enhancing performance and reliability of the compressor.

The oil supply groove 1256 may alternatively be provided in plurality more than three. In this case, the overall length and/or the inclination angle of the oil supply groove 1256 may further increase.

Hereinafter, a description will be given of another embodiment of an oil supply structure.

That is, in the previous embodiment, the first oil supply groove and the second oil supply groove are formed symmetrically with respect to the communication groove, but in some cases, the first oil supply groove and the second oil supply groove may be formed asymmetrically with respect to the communication groove.

Figure 6:
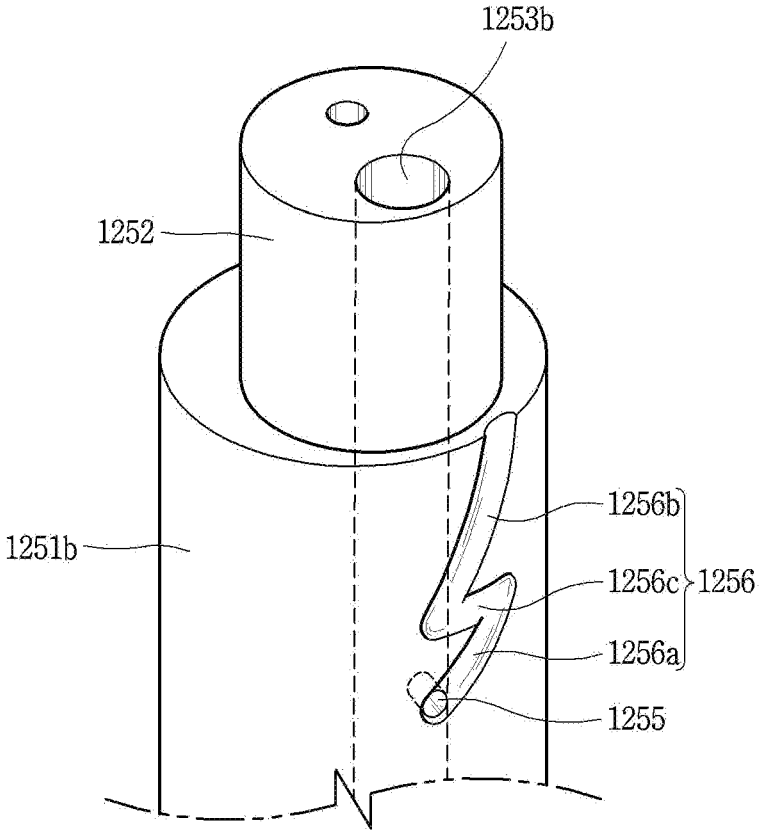
FIG. 6 is a perspective view illustrating another embodiment of an oil supply structure in FIG. 2.
Figure 7:
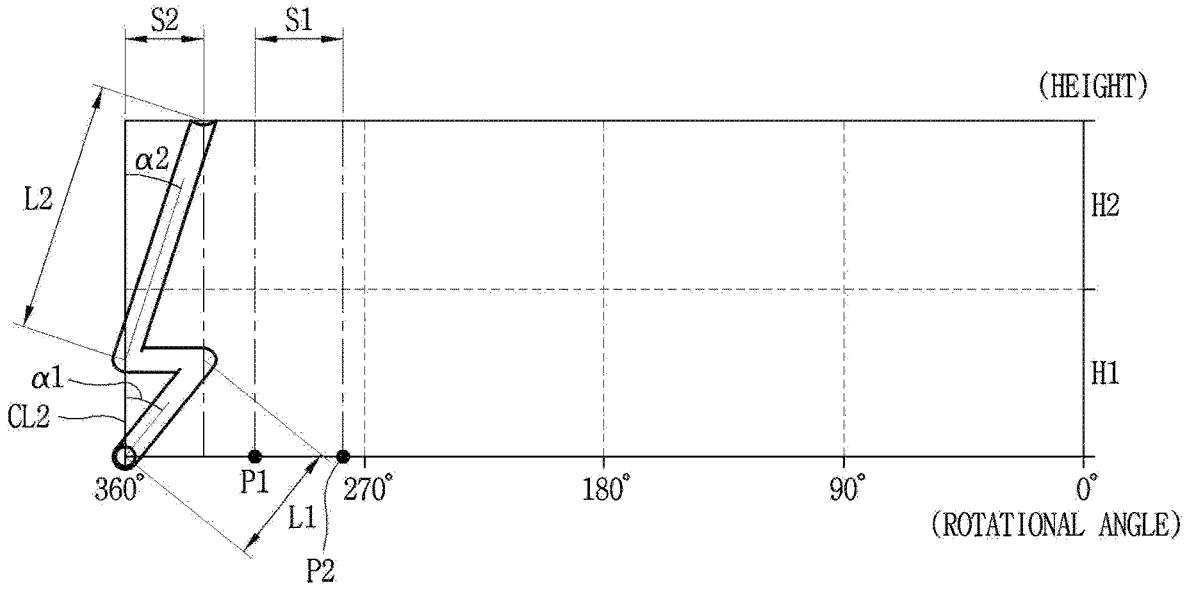
FIG. 7 is a development view of FIG. 6.
Figure 8:
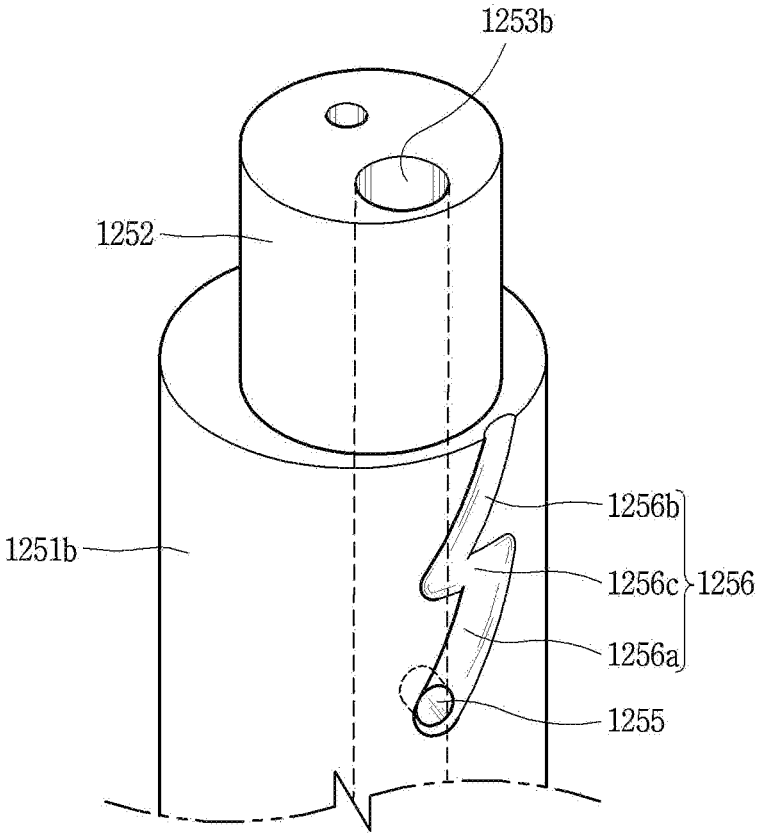
FIG. 8 is a perspective view illustrating another embodiment of an oil supply structure in FIG. 2.
Figure 9:
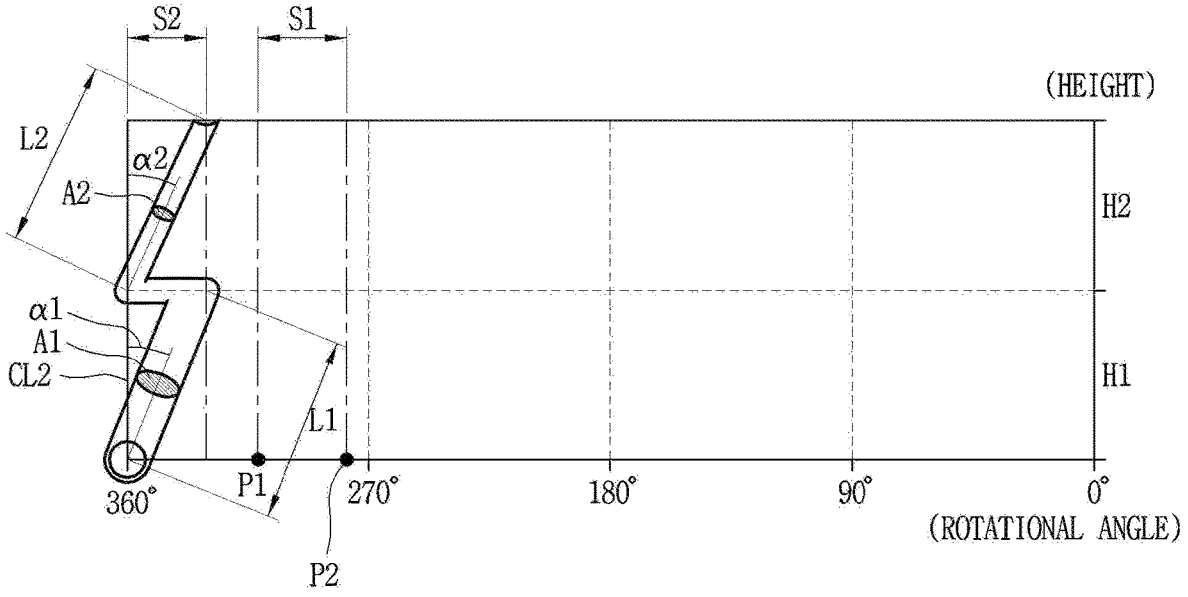
FIG. 9 is a development view of FIG. 8.

FIG. 6 is a perspective view illustrating another embodiment of an oil supply structure in FIG. 2, FIG. 7 is a development view of FIG. 6, FIG. 8 is a perspective view illustrating another embodiment of an oil supply structure in FIG. 2, and FIG. 9 is a development view of FIG. 8.

Referring to FIGS. 6 to 9, an oil supply structure of a scroll compressor according to this embodiment is similar to that in the previous embodiment. In other words, the oil passage 1253 of this embodiment includes the first passage 1253*a* and the second passage 1253*b*, and the second passage 1253*b* includes the oil supply hole 1255 and the oil supply groove 1256 for supplying oil between the bearing hole 132*a* of the main bearing portion 132 and the main bearing surface portion 1251*b* of the rotating shaft 125.

The oil supply hole 1255 is provided by one in number, and the oil supply groove 1256 includes a plurality of oil supply grooves 1256*a*, 1256*b*, and 1256*c* connected to one another. In other words, in the oil supply groove 1256, a lower end of the first oil supply groove 1256*a* defining an inlet communicates with the oil supply hole 1255, and an upper end of the second oil supply groove 1256*b* defining an outlet communicates with an upper end of the main shaft portion 1251. The basic configuration of the oil supply hole 1255 and the oil supply groove 1256 and the operating effects thereof are almost the same as those of the previous embodiment, so a detailed description thereof will be replaced with the description of the previous embodiment of FIG. 5.

However, the oil supply groove 1256 according to this embodiment includes the first oil supply groove 1256*a* and the second oil supply groove 1256*b*, but the first oil supply groove 1256*a* and the second oil supply groove 1256*b* may have different standards. For example, the first oil supply groove 1256*a* and the second oil supply groove 1256*b* may have different inclination angles, different lengths, different heights, and/or different cross-sectional areas.

Specifically, as illustrated in FIGS. 6 and 7, the first oil supply groove 1256*a* and the second oil supply groove 1256*b* are both formed in the oil supply guide section S2 as in the previous embodiment. Here, the inclination angle $\alpha$1 of the first oil supply groove 1256*a* is larger than the inclination angle $\alpha$2 of the second oil supply groove 1256*b*. In other words, the first oil supply groove 1256*a* and the second oil supply groove 1256*b* may be formed within the same range in the circumferential direction, but the first oil supply groove 1256*a* may be more inclined than the second oil supply groove 1256*b* in the axial direction. Accordingly, centrifugal force can increase in the first oil supply groove 1256*a*, so that more oil pumped along the oil passage 1253 can be introduced into the oil supply groove 1256, thereby improving the lubrication effect for the main bearing surface.

As described above, when the inclination angle $\alpha$1 of the first oil supply groove 1256*a* is larger than the inclination angle $\alpha$2 of the second oil supply groove 1256*b*, the length L1 of the first oil supply groove 1256*a* may become shorter than or equal to the length L1 of the first oil supply groove 1256*a* according to the embodiment of FIG. 5, but the inclination angle $\alpha$1 of the first oil supply groove 1256*a* may increase more than the inclination angle $\alpha$1 of the first oil supply groove 1256*a* according to the previous embodiment of FIG. 5, based on the same length.

Then, as more oil flows into the oil supply groove 1256 by virtue of the increased centrifugal force in the first oil supply groove 1256*a*, the oil supply groove 1256 can be located farther away from the oil film pressure section. This can more effectively suppress the oil film damage due to the oil supply groove 1256.

In addition, in the oil supply groove 1256 according to this embodiment, the length L1 of the first oil supply groove 1256*a* may also be formed shorter than the length L2 of the second oil supply groove 1256*b*. In other words, as illustrated in FIG. 5, the first oil supply groove 1256*a* and the second oil supply groove 1256*b* are formed within the oil supply guide section S2, but the length L1 of the first oil supply groove 1256*a* may be shorter than the length L2 of the second oil supply grove 1256*b*. Accordingly, as the length between the both ends of the first oil supply groove 1256*a* is shortened within the same range in the circumferential direction, the inclination angle $\alpha$1 of the first oil supply groove 1256*a* increases as described above. In proportion to this, the centrifugal force in the first oil supply groove 1256*a* can increase and thus more oil can be introduced into the oil supply groove 1256, thereby improving the lubrication effect for the main bearing surface.

As described above, when the length L1 of the first oil supply groove 1256*a* is shorter than the length L2 of the second oil supply groove 1256*b*, the centrifugal force in the first oil supply groove 1256*a* can increase, such that a larger amount of oil can be introduced into the first oil supply groove 1256*a*. Accordingly, even if the oil supply groove 1256 is located farther away from the oil film pressure section S1, an appropriate amount of oil to be supplied can be secured, so as to more effectively suppress the oil film damage due to the oil supply groove 1256.

In addition, in the oil supply groove 1256 according to this embodiment, the height H1 of the first oil supply groove 1256*a* may also be formed shorter than the height H2 of the second oil supply groove 1256*b*. In other words, as illustrated in FIGS. 6 and 7, the height H1 of the first oil supply groove 1256*a* may be formed lower than the height H2 of the second oil supply groove 1256*b*. Accordingly, even under the condition that the length L1 of the first oil supply groove 1256*a* and the length L2 of the second oil supply groove 1256*b* are the same, the first oil supply groove 1256*a* is lower than the second oil supply groove 1256*b* and the inclination angle $\alpha$1 of the first oil supply groove 1256*a* increases as described above. In proportion to this, centrifugal force in the first oil supply groove 1256*a* can increase and thus more oil can be introduced into the oil supply groove 1256, thereby improving the lubrication effect for the main bearing.

As described above, when the height H1 of the first oil supply groove 1256*a* is shorter than the height H1 of the second oil supply groove 1256*b*, the centrifugal force in the first oil supply groove 1256*a* can increase, such that a larger amount of oil can be introduced into the first oil supply groove 1256*a*. Accordingly, even if the oil supply groove 1256 is located farther away from the oil film pressure section S1, an appropriate amount of oil to be supplied can be secured, so as to more effectively suppress the oil film damage due to the oil supply groove 1256. In this embodiment, the second oil supply groove 1256*b* can be located farther away from the oil film pressure section S1 than the first oil supply groove 1256*a*. This can more effectively suppress the oil film damage due to the oil supply groove 1256.

Also, as illustrated in FIGS. 8 and 9, the cross-sectional area A1 of the first oil supply groove 1256*a* may be larger than the cross-sectional area A2 of the second oil supply groove 1256*b*. For example, the inclination angle $\alpha$1 of the first oil supply groove 1256*a* and the inclination angle $\alpha$2 of the second oil supply groove 1256*b* may be the same, the length L1 of the first oil supply groove 1256*a* and the length L2 of the second oil supply groove 1256*b* may be the same, and the height H1 of the first oil supply groove 1256*a* and the height H2 of the second oil supply groove 1256*b* may be the same. In this case, a width and/or depth of the first oil supply groove 1256*a* may be larger than a width and/or depth of the second oil supply groove 1256*b*.

As described above, when the cross-sectional area A1 of the first oil supply groove 1256*a* is larger than the cross-sectional area A2 of the second oil supply groove 1256*b*, flow resistance in the first oil supply groove 1256*a* may decrease and thus a larger amount of oil may be introduced into the oil supply groove 1256. Accordingly, the oil supply groove 1256 can be located farther away from the oil film pressure section S1, so as to effectively suppress the oil film damage due to the oil supply groove 1256. This may be equally applied to a case where the inclination angle α1 of the first oil supply groove 1256*a* is different from the inclination angle α2 of the second oil supply groove 1256*b*, the length L1 of the first oil supply groove 1256*a* is different from the length L2 of the second oil supply groove 1256*b*, and/or the height H1 of the first oil supply groove 1256*a* is different from the height H2 of the second oil supply groove 1256*b*.

Hereinafter, a description will be given of still another embodiment of an oil supply structure.

That is, in the previous embodiment, the communication groove is formed in the circumferential direction, but in some cases, the communication groove may be inclined with respect to the circumferential direction.

Figure 10:
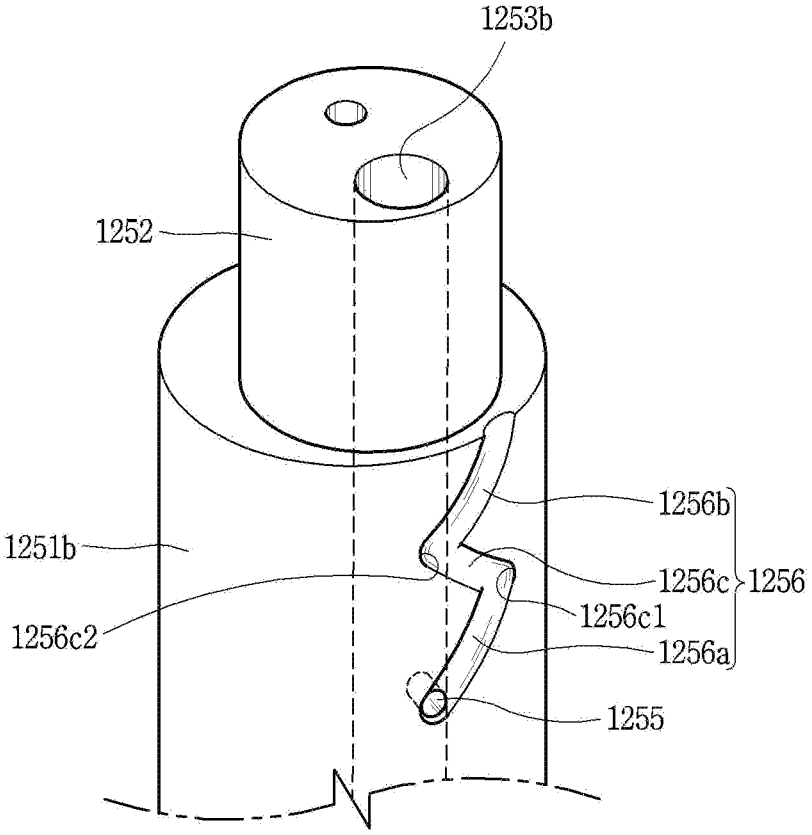
FIG. 10 is a perspective view illustrating another embodiment of an oil supply structure in FIG. 2.
Figure 11:
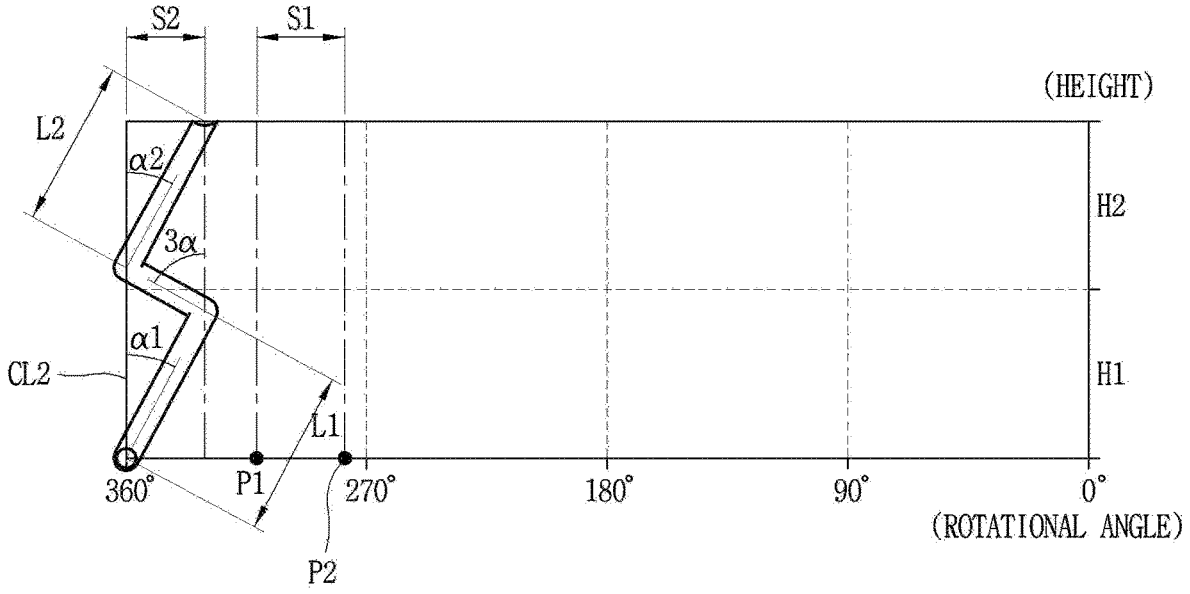
FIG. 11 is a development view of FIG. 10.
Figure 12:
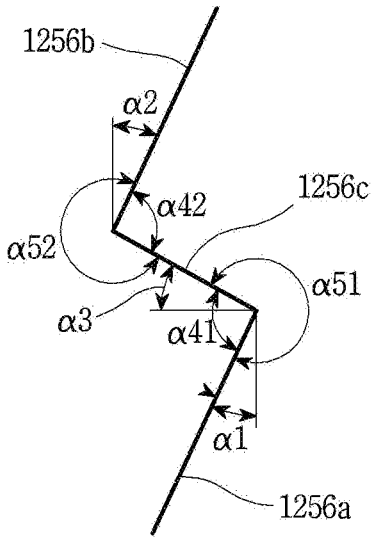
FIG. 12 is a schematic view illustrating an oil supply groove in FIG. 11.

FIG. 10 is a perspective view illustrating another embodiment of an oil supply structure in FIG. 2, FIG. 11 is a development view of FIG. 10, and FIG. 12 is a schematic view illustrating an oil supply groove in FIG. 11.

Referring to FIGS. 10 to 12, an oil supply structure of a scroll compressor according to this embodiment is similar to that in the previous embodiment. In other words, the oil passage 1253 of this embodiment includes the first passage 1253*a* and the second passage 1253*b*, and the second passage 1253*b* includes the oil supply hole 1255 and the oil supply groove 1256 for supplying oil between the bearing hole 132*a* of the main bearing portion 132 and the main bearing surface portion 1251*b* of the rotating shaft 125.

The oil supply hole 1255 is provided by one in number, and the oil supply groove 1256 includes a plurality of oil supply grooves 1256*a*, 1256*b*, and 1256*c* connected to one another. In other words, in the oil supply groove 1256, a lower end of the first oil supply groove 1256*a* defining an inlet communicates with the oil supply hole 1255, and an upper end of the second oil supply groove 1256*b* defining an outlet communicates with an upper end of the main shaft portion 1251. The basic configuration of the oil supply hole 1255 and the oil supply groove 1256 and the operating effects thereof are almost the same as those of the previous embodiment, so a detailed description thereof will be replaced with the description of the previous embodiment of FIG. 5.

However, the first oil supply groove 1256*a* and the second oil supply groove 1256*b* according to this embodiment are connected through the communication groove 1256*c*, and the communication groove 1256*c* is inclined by a preset angle with respect to the circumferential direction. In other words, the communication groove 1256*c* may not be inclined with respect to axial direction of the rotating shaft 125 but be inclined with respect to the circumferential direction (or transverse direction) that is orthogonal to the axial direction. Accordingly, the communication groove 1256*c* may be formed to have different heights at both ends thereof.

Referring to FIGS. 10 to 12, the communication groove 1256*c* is formed in a direction crossing the first oil supply groove 1256*a* and/or the second oil supply groove 1256*b*, and an angle (first interior angle) α41 between the first oil supply groove 1256*a* and the communication groove 1256*c* and an angle (second interior angle) α42 between the communication groove 1256*c* and the second oil supply groove 1256*b* may be larger than those in the embodiments of FIGS. 5, 7, and 9.

In other words, the communication groove 1256*c* is formed to have different heights at both ends thereof, but the first end 1256*c*1 of the communication groove 1256*c* connected to the first oil supply groove 1256*a* may be located lower than the second end 1256*c*2 of the communication groove 1256*c* connected to the second oil supply groove 1256*b*. Accordingly, the communication groove 1256*c* may be formed to be higher from a rear side toward a front side.

In this case, the inclination angle α3 of the communication groove 1256*c* may be smaller than or equal to the inclination angle α1 of the first oil supply groove 1256*a* and/or the inclination angle α2 of the second oil supply groove 1256*b*. Accordingly, the communication groove 1256*c* can be inclined with respect to the circumferential direction, and even an excessive decrease in the length L1 of the first oil supply groove 1256*a* and/or the length L2 of the second oil supply groove 1256*b* can be suppressed.

As described above, when the communication groove 1256*c* is formed to be inclined with respect to a transverse (lateral) direction or the circumferential direction that is orthogonal to the axial direction, a bend angle (first external angle) α51 between the first oil supply groove 1256*a* and the communication groove 1256*c* and a bend angle (second external angle) α52 between the communication groove 1256*c* and the second oil supply groove 1256*b* are decreased, respectively.

Then, the angle between the first oil supply groove 1256*a* and the communication groove 1256*c* and the angle between the communication groove 1256*c* and the second oil supply groove 1256*b* become wider to be relatively close to a straight line.

Accordingly, oil can move quickly from the first oil supply groove 1256*a* to the communication groove 1256*c* and from the communication groove 1256*c* to the second oil supply groove 1256*b*. This can increase the amount of oil to be supplied from the oil supply hole 1255 to the oil supply groove 1256 as a whole, so that the lubrication effect on the main bearing surface can be further improved.

The angle (the first internal angle) α41 between the first oil supply groove 1256*a* and the communication groove 1256*c* and/or the angle (second internal angle) α42 between the communication groove 1256*c* and the second oil supply groove 1256*b* may be smaller than those in the embodiment of FIG. 12. In other words, the first end 1256*c*1 of the communication groove 1256*c* connected to the first oil supply groove 1256*a* may be located higher than the second end 1256*c*2 of the communication groove 1256*c* connected to the second oil supply groove 1256*b*. Accordingly, the communication groove 1256*c* may be formed to be lower from a rear side toward a front side. In this case, an oil storage effect in the communication groove 1256*c* can be improved when the compressor is stopped, and accordingly the lubrication effect on the main bearing surface can be increased when the compressor is restarted.

However, even in this case, the inclination angle α3 of the communication groove 1256*c* may be smaller than or equal to the inclination angle α1 of the first oil supply groove 1256*a* and/or the inclination angle α2 of the second oil supply groove 1256*b*. This can make the communication groove 1256*c* inclined with respect to the circumferential direction and suppress an excessive increase in flow resistance in the communication groove 1256*c*.

Hereinafter, a description will be given of still another embodiment of an oil supply structure.

That is, in the previous embodiments, the first oil supply groove and the second oil supply groove are connected to the communication groove, but in some cases, the first oil supply groove and the second oil supply groove may be connected to oil supply holes, respectively.

Figure 13:
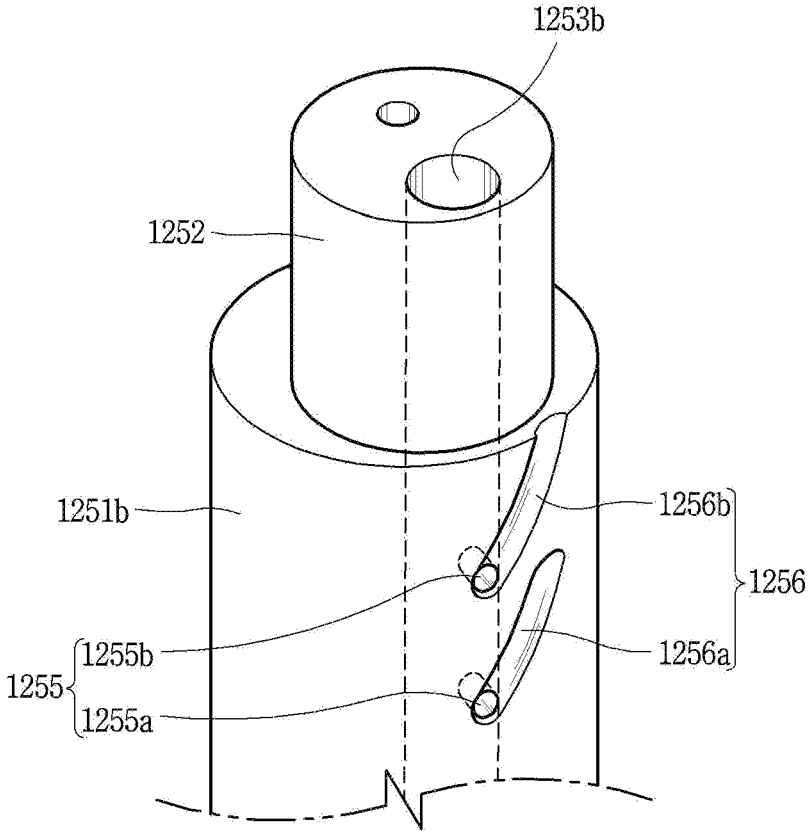
FIG. 13 is a perspective view illustrating another embodiment of an oil supply structure in FIG. 2.
Figure 14:
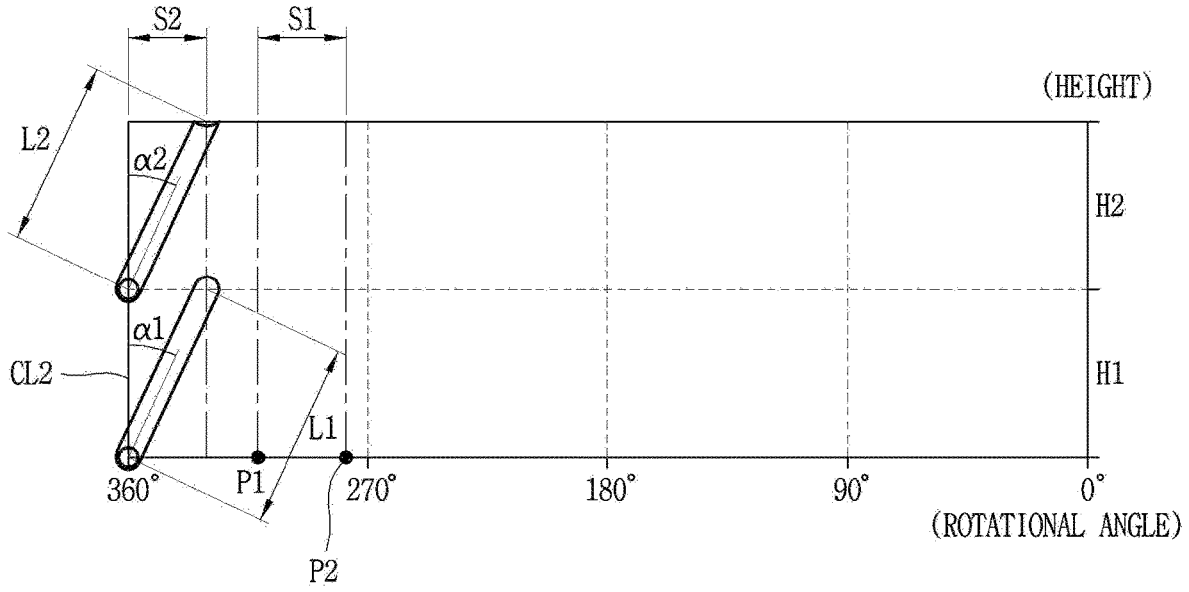
FIG. 14 is a development view of FIG. 13.

FIG. 13 is a perspective view illustrating another embodiment of an oil supply structure in FIG. 2, and FIG. 14 is a development view of FIG. 13.

Referring to FIGS. 13 and 14, the oil supply structure of the scroll compressor according to this embodiment is similar to that in the previous embodiment. In other words, the oil passage 1253 of this embodiment includes the first passage 1253*a* and the second passage 1253*b*, and the second passage 1253*b* includes the oil supply hole 1255 and the oil supply groove 1256 for supplying oil between the bearing hole 132*a* of the main bearing portion 132 and the main bearing surface portion 1251*b* of the rotating shaft 125.

The oil supply groove 1256 includes the first oil supply groove 1256*a* and the second oil supply groove 1256*b* as in the previous embodiments. In other words, the inclination angle $\alpha$1 of the first oil supply groove 1256*a* may be the same as or different from the inclination angle $\alpha$2 of the second oil supply groove 1256*b*, the length L1 of the first oil supply groove 1256*a* may be the same as or different from the length L2 of the second oil supply groove 1256*b*, the height H1 of the first oil supply groove 1256*a* may be the same as or different from the height H2 of the second oil supply groove 1256*b*, and the cross-sectional area A1 of the first oil supply groove 1256*a* may be the same as or different from the cross-sectional area A2 of the second oil supply groove 1256*b*. Since the basic configuration and the effect thereof for these oil supply grooves 1256*a* and 1256*b* are almost the same as those of the previous embodiments, a detailed description thereof will be replaced with the description of the embodiment of FIG. 5.

However, the oil supply hole 1255 according to this embodiment may be provided in plurality, and the plurality of oil supply holes 1255*a* and 1255*b* may be independently connected to the oil supply grooves 1256*a* and 1256*b*. Accordingly, even if an inclination or total length of the oil supply groove 1256 increases, oil accumulation or bottleneck in the oil supply groove 1256 can be suppressed, thereby increasing an amount of oil to be supplied.

Specifically, the oil supply hole 1255 according to this embodiment may include a first oil supply hole 1255*a* and a second oil supply hole 1255*b*. For example, the first oil supply hole 1255*a* and the second oil supply hole 1255*b* may be formed respectively in the rotating shaft 125 along the axial direction. The first oil supply groove 1256*a* may be connected to the first oil supply hole 1255*a* and the second oil supply groove 1256*b* may be connected to the second oil supply hole 1255*b*. In other words, the first oil supply groove 1256*a* and the second oil supply groove 1256*b* may be independently connected to the oil supply holes 1255*a* and 1255*b*. In this case, the communication groove 1256*c* formed in the previous embodiments may be excluded.

The first oil supply hole 1255*a* and the second oil supply hole 1255*b* may be formed on the same axial line or on different axial lines. This embodiment illustrates an example in which the first oil supply hole 1255*a* and the second oil supply hole 1255*b* are formed on the same axial line.

As described above, when the first oil supply groove 1256*a* and the second oil supply groove 1256*b* are independently connected to the respective oil supply holes 1255*a* and 1255*b*, the first oil supply groove 1256*a* and the second oil supply groove 1256*b* are independently connected to the oil passage (second passage) 1253. This can generate centrifugal force independently in the first oil supply groove 1256*a* and the second oil supply groove 1256*b*.

In other words, in the previous embodiments, the centrifugal force in the second oil supply groove 1256*b* is dependent on the centrifugal force in the first oil supply groove 1256*a*. However, in this embodiment, as the first oil supply groove 1256*a* and the second oil supply groove 1256*a* define passages independent of each other, the centrifugal force in the second oil supply groove 1256*b* is not limited by the first oil supply groove 1256*a*. Accordingly, the centrifugal force in the first oil supply groove 1256*a* as well as the centrifugal force in the second oil supply groove 1256*b* can be highly generated, so that an overall amount of oil to be supplied can be increased. With the configuration, the first oil supply groove 1256*a* and the second oil supply groove 1256*b* can be located farther away from the oil film pressure section, so that damage on the oil film due to the oil supply groove 1256 can be more effectively suppressed.

Hereinafter, a description will be given of still another embodiment of an oil supply structure.

That is, in the previous embodiments, the entire oil supply groove is formed within the range of the oil supply guide section, but in some cases, a portion of the oil supply groove may be formed outside the range of the oil supply guide section. In other words, the first oil supply groove and the second oil supply groove may be formed asymmetrically with respect to the communication groove.

Figure 15:
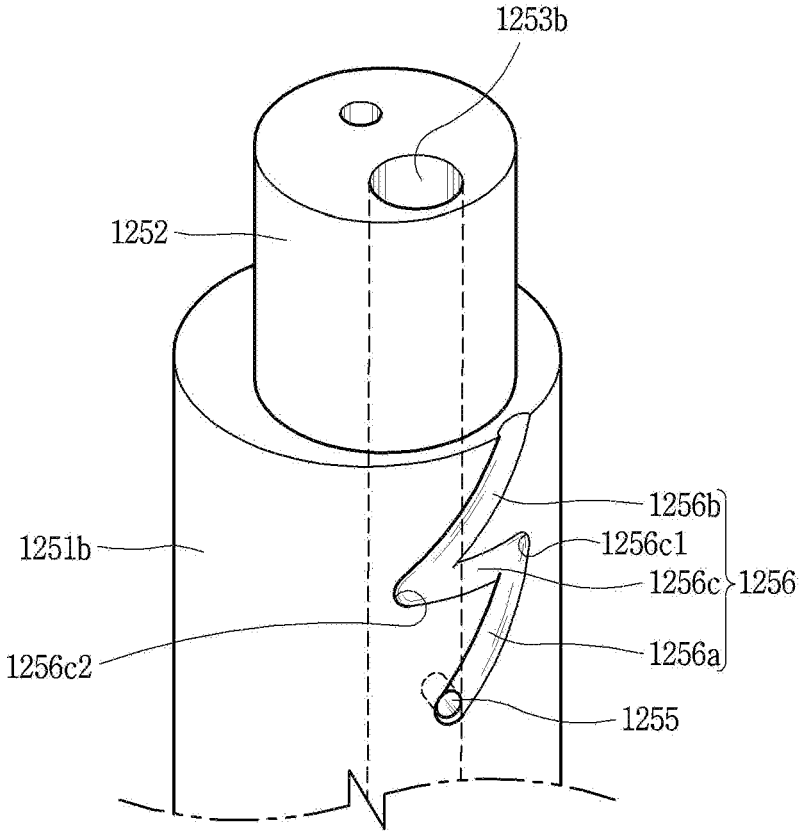
FIG. 15 is a perspective view illustrating still another embodiment of an oil supply structure in FIG. 2.
Figure 16:
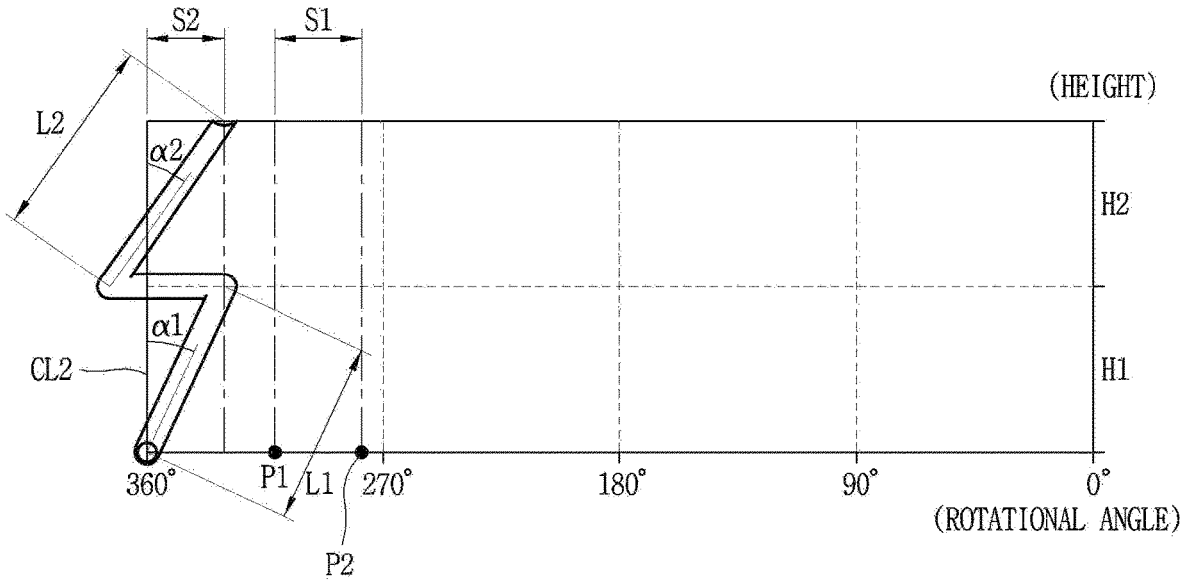
FIG. 16 is a development view of FIG. 15.

FIG. 15 is a perspective view illustrating still another embodiment of an oil supply structure in FIG. 2, and FIG. 16 is a development view of FIG. 15.

Referring to FIGS. 15 and 16, the oil supply structure of the scroll compressor according to this embodiment is similar to that in the previous embodiment. In other words, the oil passage 1253 of this embodiment includes the first passage 1253*a* and the second passage 1253*b*, and the second passage 1253*b* includes the oil supply hole 1255 and the oil supply groove 1256 for supplying oil between the bearing hole 132*a* of the main bearing portion 132 and the main bearing surface portion 1251*b* of the rotating shaft 125.

The oil supply hole 1255 is provided by one in number, and the oil supply groove 1256 includes a plurality of oil supply grooves 1256*a*, 1256*b*, and 1256*c* connected to one another. In other words, in the oil supply groove 1256, a lower end of the first oil supply groove 1256*a* defining an inlet communicates with the oil supply hole 1255, and an upper end of the second oil supply groove 1256*b* defining an outlet communicates with an upper end of the main shaft portion 1251. The basic configuration of the oil supply hole 1255 and the oil supply groove 1256 and the operating effects thereof are almost the same as those of the previous embodiment, so a detailed description thereof will be replaced with the description of the previous embodiments of FIGS. 5, 7, 9, and 11.

However, the first oil supply groove 1256*a* and the second oil supply groove 1256*b* according to this embodiment may be connected to each other through the communication groove 1256*c*, and the communication groove 1256*c* may extend to outside of the range of the oil supply guide section S2. In other words, the communication groove 1256*c* may be formed to be longer than the communication groove 1256*c* in the previous embodiments.

For example, as illustrated in FIGS. 15 and 16, the oil supply hole 1255 may be located in an eccentric direction of the eccentric pin portion 1252, that is, on the first virtual line CL1 as in the previous embodiments. The second end 1256*c*2 of the communication groove 1256*c* may extend more toward the front side than the oil supply hole 1255, based on the rotational direction of the rotating shaft 125, over a second virtual line CL2 that passes through the center of the oil supply hole 1255 in the axial direction.

In other words, the first end 1256*c*1 of the communication groove 1256*c* connected to the first oil supply groove 1256*a* may be located at the same position as those in the previous embodiments, i.e., at a position close to the minimum gap point P1 so as not to invade the oil film pressure section S1. On the other hand, the second end 1256*c*2 of the communication groove 1256*c* connected to the second oil supply groove 1256*b* may extend to be located more forward than those in the previous embodiments, i.e., more forward than the oil supply hole 1255 based on the rotational direction of the rotating shaft 125. Accordingly, both ends of the communication groove 1256*c* can be located in both sections with respect to the second virtual line CL2, so that the oil supply guide section S2 can be formed wider than the oil supply guide sections S2 in the previous embodiments.

As described above, when the oil supply hole 1255 is located in the eccentric direction of the eccentric pin portion 1252, that is, on the same line as the first virtual line CL1 and the second end 1256*c*2 of the communication groove 1256*c* extends more forward than the oil supply hole 1255, the length of the oil supply groove 1256 that is defined as the sum of the length L1 of the first oil supply groove 1256*a*, the length L2 of the second oil supply groove 1256*b*, and the length L3 of the communication groove 1256*c* can increase more than those in the previous embodiments. This can increase a lubrication area of the oil supply guide section S2, that is, the oil supply groove 1256 on the main bearing surface.

In addition, as illustrated in FIG. 16, the inclination angle $\alpha$1 of the first oil supply groove 1256*a* and/or the inclination angle $\alpha$2 of the second oil supply groove 1256*b* can be larger than those in the previous embodiments, and accordingly the centrifugal force in the oil supply groove 1256 can increase. Accordingly, the amount of oil to be supplied to the oil supply groove 1256 can increase, so that the lubrication effect on the main bearing surface can be further improved. This may be more effective in the second oil supply groove 1256.

As described above, it may be advantageous in terms of centrifugal force that the inclination angle $\alpha$3 of the communication groove 1256*c* is smaller than or equal to the inclination angle $\alpha$1 of the first oil supply groove 1256*a* and/or the inclination angle $\alpha$2 of the second oil supply groove 1256*b*.

What is claimed is:

1. A scroll compressor comprising:

a main frame defining a bearing hole that extends therethrough in an axial direction;

a non-orbiting scroll disposed at the main frame;

an orbiting scroll configured to engage the non-orbiting scroll and define compression chambers together with the non-orbiting scroll based on the orbiting scroll orbiting; and a rotating shaft including a main bearing surface portion that is inserted through the bearing hole of the main frame and supported in a radial direction, the rotating shaft being coupled to the orbiting scroll and configured to transmit rotational force, wherein the rotating shaft comprises:

an oil passage defined through opposite ends of the rotating shaft in the axial direction, an oil supply hole defined between the oil passage and an outer circumferential surface of the rotating shaft and extending toward the bearing hole of the main frame, and a plurality of oil supply grooves being in fluid communication with the oil supply hole and defined along the outer circumferential surface of the rotating shaft at the main bearing surface portion, at least some of the plurality of oil supply grooves being spaced apart from each other on a same axis, wherein the plurality of oil supply grooves comprise:

a first oil supply groove having a first end being connected to the oil supply hole and a second end being located higher than the first end of the first oil supply groove, a second oil supply groove having a first end being spaced apart from the oil supply hole and a second end being located higher than the first end of the second oil supply groove, and a communication groove that is defined between the first oil supply groove and the second oil supply groove along the outer circumferential surface of the rotating shaft and that has a first end and a second end spaced apart from each other along the outer circumferential surface of the rotating shaft, wherein the first end of the communication groove is connected to the second end of the first oil supply groove, and wherein the second end of the communication groove is connected to the first end of the second oil supply groove.

2. The scroll compressor of claim 1, wherein the first oil supply groove has at least one of an inclination angle, a length, a height, or a cross-sectional area that is the same as at least one of an inclination angle, a length, a height, or a cross-sectional area of the second oil supply groove.

3. The scroll compressor of claim 1, wherein the first oil supply groove has at least one of an inclination angle, a length, a height, or a cross-sectional area that is different from at least one of an inclination angle, a length, a height, or a cross-sectional area of the second oil supply groove.

4. The scroll compressor of claim 3, wherein an inclination angle of the first oil supply groove is larger than an inclination angle of the second oil supply groove.

5. The scroll compressor of claim 3, wherein a length of the first oil supply groove is shorter than a length of the second oil supply groove.

6. The scroll compressor of claim 3, wherein a height of the first oil supply groove is lower than a height of the second oil supply groove.

7. The scroll compressor of claim 3, wherein a cross-sectional area of the first oil supply groove is smaller than a cross-sectional area of the second oil supply groove.

8. The scroll compressor of claim 1, wherein the communication groove is defined in a circumferential direction that is orthogonal to the axial direction.

9. The scroll compressor of claim 8, wherein the communication groove is inclined with respect to the circumferential direction.

10. The scroll compressor of claim 9, wherein the communication groove has a first groove end being connected to the first oil supply groove and a second groove end being connected to the second oil supply groove, the first groove end being lower than the second groove end.

11. The scroll compressor of claim 9, wherein an inclination angle of the communication groove is smaller than or equal to an inclination angle of the first oil supply groove or the second oil supply groove.

12. The scroll compressor of claim 1, wherein the first end of the first oil supply groove that is connected to the oil supply hole is located on a same axial line as the first end of the second oil supply groove that is connected to the communication groove.

13. The scroll compressor of claim 1, wherein the first end of the first oil supply groove that is connected to the oil supply hole is located on a different axial line from the first end of the second oil supply groove that is connected to the communication groove.

14. The scroll compressor of claim 13, wherein the first end of the second oil supply groove is located more forward than the oil supply hole based on a rotational direction of the rotating shaft.

15. The scroll compressor of claim 1, wherein the oil supply hole is a single oil supply hole, and wherein the plurality of oil supply grooves are connected to each other such that one end of the plurality of oil supply grooves is connected to the single oil supply hole.

16. The scroll compressor of claim 1, wherein the oil supply hole includes a plurality of oil supply holes being spaced apart from each other in the axial direction, and wherein the plurality of oil supply grooves are connected to the plurality of oil supply holes, respectively.

17. A scroll compressor comprising:

a main frame defining a bearing hole therethrough in an axial direction;

a non-orbiting scroll disposed at the main frame;

an orbiting scroll configured to engage the non-orbiting scroll and define compression chambers together with the non-orbiting scroll based on the orbiting scroll orbiting; and a rotating shaft including a main bearing surface portion that is inserted through the bearing hole of the main frame and supported in a radial direction, the rotating shaft being coupled to the orbiting scroll and configured to transmit rotational force, wherein the rotating shaft comprises:

an oil passage defined through opposite ends of the rotating shaft in the axial direction, an oil supply hole defined between the oil passage and an outer circumferential surface of the rotating shaft and extending toward the bearing hole of the main frame, a plurality of oil supply grooves being in fluid communication with the oil supply hole and defined along the outer circumferential surface of the rotating shaft at the main bearing surface portion, at least some of the plurality of oil supply grooves being spaced apart from each other on a same axis, and a communication groove that is defined between the plurality of oil supply grooves along the outer circumferential surface of the rotating shaft and that has a first end and a second end spaced apart from each other along the outer circumferential surface of the rotating shaft, wherein the plurality of oil supply grooves comprise (i) a first oil supply groove having a first end and a second end and (ii) a second oil supply groove having a first end and a second end, wherein the first end of the communication groove is connected to the second end of the first oil supply groove, and wherein the second end of the communication groove is connected to the first end of the second oil supply groove.

18. The scroll compressor of claim 17, wherein the plurality of oil supply grooves have the same inclination angle, length, height, or cross-sectional area.

* * * * *